US007623806B2

(12) United States Patent
Tanase

(10) Patent No.: US 7,623,806 B2
(45) Date of Patent: Nov. 24, 2009

(54) CHARGING DEVICE AND IMAGE FORMING APPARATUS

(75) Inventor: Masami Tanase, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 181 days.

(21) Appl. No.: 11/806,010

(22) Filed: May 29, 2007

(65) Prior Publication Data

US 2008/0159776 A1 Jul. 3, 2008

(30) Foreign Application Priority Data

Dec. 27, 2006 (JP) ..... P2006-352356

(51) Int. Cl.
*G03G 15/02* (2006.01)

(52) U.S. Cl. ..... 399/100; 399/92; 399/170; 399/171; 399/172

(58) Field of Classification Search ..... 399/71, 399/92, 93, 100, 170, 171, 172
See application file for complete search history.

(56) References Cited

U.S. PATENT DOCUMENTS 5,023,748 A * 6/1991 Okamoto et al. ..... 399/100
2005/0074254 A1* 4/2005 Maeda ..... 399/92
2005/0152713 A1* 7/2005 Maeda et al. ..... 399/93
2008/0199206 A1* 8/2008 Zona et al. ..... 399/100

FOREIGN PATENT DOCUMENTS

CN 1480798 A 3/2004
JP 2003-345111 A 12/2003
JP 2005-107236 4/2005

* cited by examiner

*Primary Examiner*—David M Gray
*Assistant Examiner*—Gregory H Curran
(74) *Attorney, Agent, or Firm*—Morgan, Lewis & Bockius LLP

(57) ABSTRACT

A charging device includes: a charged body; a charging member that extends parallel to the surface of the charged body, a charging voltage being applied between the charging member and the charged body; a cleaning member that is in contact with the charging member, and that moves in an extending direction of the charging member to remove matters adhering to the charging member; and an air introduction path that introduces airflow flowing in one orientation with respect to the extending direction of the charging member at a position along the charging member, the cleaning member being in contact with the charging member in a case where the cleaning member moves in the one orientation, and the cleaning member being separated from the charging member in a case where the cleaning member moves in an orientation opposite to the airflow in a state in which the airflow is generated.

19 Claims, 20 Drawing Sheets

CROSS-SECTION TAKEN ON A-A

CROSS-SECTION TAKEN ON A-A

CROSS-SECTION TAKEN ON B-B

CROSS-SECTION TAKEN ON C-C

CROSS-SECTION TAKEN ON A-A

CROSS-SECTION TAKEN ON B-B

CROSS-SECTION TAKEN ON A-A

CROSS-SECTION TAKEN ON A-A

CHARGING DEVICE AND IMAGE FORMING APPARATUS

CROSS-REFERENCE TO RELATED APPLICATIONS

This application is based on and claims priority under 35 U.S.C. 119 from Japanese Patent Application No. 2006-352356 filed Dec. 27, 2006.

BACKGROUND

1. Technical Field

The present invention relates to a charging device, and to an image forming apparatus.

2. Related Art

A charging device utilizing corona discharge is used for charging an image holder, on which an electrostatic latent image is formed due to a difference in potential level, to a predetermined potential level in, for example, an electrophotographic image forming apparatus.

In a charging device used for such a purpose, a strong electric field is generated between a charging member, such as a stretched wire, and an image holder serving as a charged body so that a corona discharge is caused. Thus, sometimes, toner and paper particles having electric charges adhere to the charging member. Also discharge products such as ozone and nitrogen oxides sometimes adhere to the charging member. Such matters adhering to the charging member may degrade charging characteristics. Accordingly, necessity for removing the matters adhering to the charging member arises.

SUMMARY

According to an aspect of the present invention, a charging device comprising: a charged body; a charging member that is disposed at a predetermined distance from a surface of the charged body, and that extends parallel to the surface of the charged body, a charging voltage being applied between the charging member and the charged body; a cleaning member that is in contact with the charging member, and that moves in an extending direction of the charging member to remove matters adhering to the charging member; and an air introduction path that introduces airflow flowing in one orientation with respect to the extending direction of the charging member at a position along the charging member, the cleaning member being in contact with the charging member in a case where the cleaning member moves in the one orientation, and the cleaning member being separated from the charging member in a case where the cleaning member moves in an orientation opposite to the airflow in a state in which the airflow is generated.

BRIEF DESCRIPTION OF THE DRAWINGS

Exemplary embodiment of the present invention will be described in detail based on the following figures, wherein.

DETAILED DESCRIPTION

Hereinafter, embodiments of the invention are described with reference to the accompanying drawings.

Figure 1:
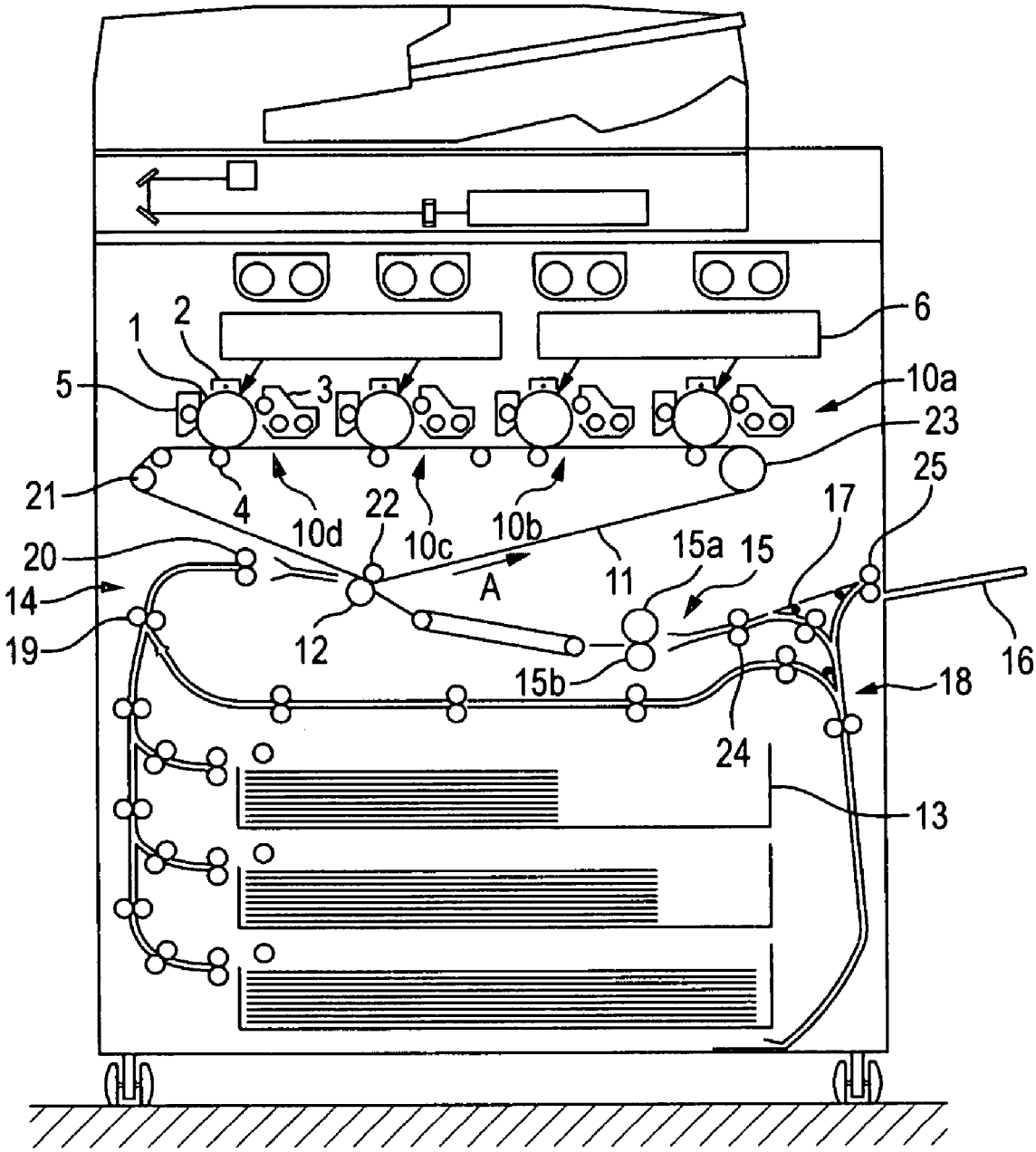
FIG. 1 is a schematic view illustrating the configuration of an image forming apparatus having a charging device according to an embodiment of the invention.

FIG. 1 is a schematic view illustrating the configuration of an image forming apparatus having a charging device according to the embodiment of the invention.

This image forming apparatus has four image forming units 10*a*, 10*b*, 10*c*, and 10*d*, respectively forming yellow, magenta, cyan, and black toner images. An endless-belt-like intermediate transfer body 11 is supported to face these image forming units to have a circumferential surface adapted to be revolved. A transfer roll 12 adapted to perform secondary transfer is disposed at the side of the downstream side of the position facing the image forming units in the direction of the movement of the circumferential surface to face the intermediate transfer body 11. A recording sheet is sent to the downstream side of the second transfer portion through a conveying path 14 from a sheet tray 13. A fixing device 15 adapted to heat and pressurize a toner image to fix the toner image onto the recording sheet is provided at the downstream side of the second transfer portion in a recording sheet conveying path. A paper discharge tray 16 configured to accommodate the recording sheet, onto which the toner image is fixed, is provided at the more downstream side. A gate 17 is provided on the conveying path from the fixing device 12 to the paper discharge tray 16. Also, a double-sided conveying path 18 used to send the sheet again to the upstream side of the position, at which the transfer roll 12 is provided, by reversing the recording sheet. A user interface having a display portion and an input portion (not shown) is provided in this image forming apparatus. An operator operates the image forming apparatus, using the interface. In the present embodiment, a side, at which the user interface is installed, is referred to as the front side.

On the other hand, a conveying roll 19 adapted to convey a recording sheet by putting the recording sheet in between opposed two rolls and by being rotationally driven is provided on the conveying path 14 extending from the sheet tray 13 to the secondary transfer portion. Resist rolls 20 adapted to adjust timing, with which a recording sheet is sent to the secondary transfer portion, are provided at the upstream side of the secondary transfer portion.

Figure 2:
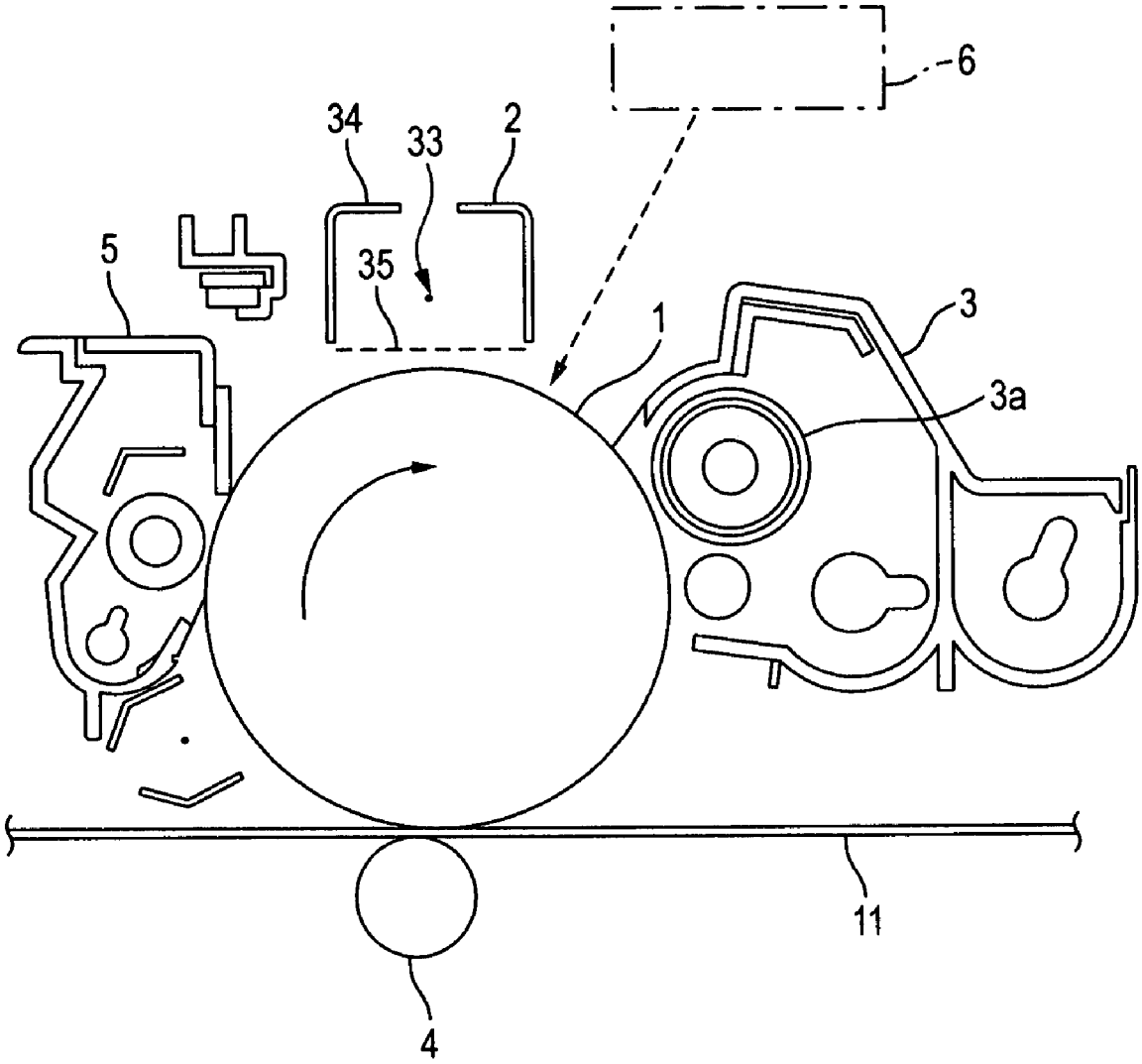
FIG. 2 is a schematic view illustrating the configuration of an image forming apparatus having an image forming unit shown in FIG. 1.

Each of the image forming units 10*a*, 10*b*, 10*c*, and 10*d* has a photoreceptor drum 1, on which an electrostatic latent image is formed, as an example of the image holder, as illustrated in FIG. 2. A charging device 2 adapted to substantially uniformly charge a surface of the photoreceptor drum, a developing device 3 adapted to selectively transfer toner onto a latent image formed on the photoreceptor drum 1 to thereby form a toner image, a transfer device 4 adapted to perform primary transfer of a toner image, which is formed on the photoreceptor drum 1, onto the intermediate transfer body 11, and a cleaning device 5 adapted to collect residual toner on the photoreceptor drum 1 after the transfer are provided around each of the photoreceptor drums 1. Also, an exposure light device 6 configured to irradiate image light according to image signals onto each of the uniformly charged photoreceptor drums 1 to write electrostatic latent images thereto is provided therearound.

The charging device 2 has an electrode wire 33 stretched at a predetermined distance from the circumferential surface of the photoreceptor drum 1. A voltage is applied between the electrode wire 33 and the photoreceptor drum 1 to cause a corona discharge. Thus, the surface of the photoreceptor drum 1 is charged. This charging device will be described in detail later.

The image exposure device 6 generates blinking laser light according to image signals. This light is scanned by a polygon mirror in a main scanning direction (i.e., a direction of an axis line) of each of the photoreceptor drums 1. Consequently, on the surface of each of the photoreceptor drums 1, an electric latent image corresponding to an image of an associated color is formed.

The developing device 3 uses a two-component developer including a toner and a magnetic carrier as a developer. The developer is conveyed by being magnetically absorbed by the developing roll 3*a* facing the photoreceptor drum 1. Then, a layer of the developer having an appropriate thickness is formed on the developing roll 3*a* by a regulating blade. Subsequently, the layer of the developer is supplied to a position facing the photoreceptor drum 1. A developing bias voltage Vd (e.g., −500V) is applied to the developing roll 3*a* to transfer an electrostatic latent image on the photoreceptor drum 1.

The photoreceptor drums 1 are configured so that an organic photoreceptor layer is formed on the circumferential surface of a cylindrical member made of metal, and is grounded at a metal part thereof. Additionally, a bias voltage VI (e.g., −200V) may be applied thereto.

The intermediate transfer body 11 disposed to face image forming units 10*a*, 10*b*, 10*c*, and 10*d* is formed of resin film having a thickness of about 10 μm to 300 μm. Polyimide film or the like is used as the resin film. To prevent distortion of an image from occurring when a toner image is electrostatically transferred to the intermediate transfer body 11 from the photoreceptor drum 1, fine powder of an electrically conductive material such as carbon black is mixed into the resin film, so that a volume resistivity is adjusted to about $10^{10}$ Ωcm.

The drive roll 21, the opposed roll 22, and the support roll 23 are disposed inside the intermediate transfer body 11. The intermediate transfer body 11 is stretched on these rolls and is adapted to move by revolving in the direction of arrow A shown in FIG. 1.

The transfer roll 12 is provided at a position facing the opposed roll 22, and is pushed against the opposed roll 22 through the intermediate transfer body 11. The transfer roll 12 is configured by forming an outer circumferential portion made of an electrically conductive rubber material on a metal core, and is shaped like a roll. A bias voltage is applied between the transfer roll 21 and the opposed roll 22.

The fixing device 15 has a heating roll 15*a* into which incorporates a heat source, and a pressure roll 15*b* press-contacted with the heating roll 15*a*. These rolls are disposed in parallel and constitute a nip portion nipping at a recording sheet. A recording sheet, onto which a toner image is transferred, is fed to the nip portion. Then, this recording sheet is heated and pressurized between the heating roll 15*a* and the pressure roll 15*b*, which are rotationally driven, so that molten toner is bonded by pressure on the recording sheet.

A recording sheet conveying roll 24, and a paper discharge roll 25 used to send a recording sheet a paper discharge tray 16 are provided on a downstream side conveying path of the fixing device 15. A gate 17 configured to change a direction of conveyance of a recording sheet is provided between the conveying roll 24 and the paper discharge roll 25. The gate 17 is adapted to change the direction of conveyance of a recording sheet, and is enabled to feed the recording sheet to the double-sided conveying path 18 used to send a recording sheet again to the transfer portion by reversing the direction of conveyance thereof.

The image forming apparatus operates as follows.

In response to a signal instructing to start an image forming operation, the four image forming units 10*a*, 10*b*, 10*c*, and 10*d* disposed to face the intermediate transfer body 11 form a yellow toner image, a magenta toner image, a cyan toner image, and a black toner image, respectively. The formation of toner images is conducted by performing the following steps.

Each of the photoreceptor drums 1 is substantially uniformly charged by the charging device 2. Laser light turned on/off in response to an image signal sent from the image exposure device 6 is irradiated thereonto. Consequently, charges at each position irradiated with light are attenuated.

Thus, a latent image is formed on a surface of each of the photoreceptor drums 1 due to the difference of an electrostatic potential level. The latent image formed on the surface of each of the photoreceptor drums 1 is developed at the position facing the developing device 3 by the transfer of toner, so that the toner images are formed on the surface of the photoreceptor drum 1.

The color toner images formed thereon are superposed and transferred onto the intermediate transfer body 11 by the transfer device 4. Consequently, a color image is formed on the intermediate transfer body 11 by superposing toner images of a plurality of colors thereon. The toner images of a plurality of colors formed on the intermediate transfer body 11 are conveyed to the secondary transfer portion facing the transfer roll 12 by the revolving movement of the intermediate transfer body 11.

On the other hand, a recording sheet is drawn out of the sheet tray 13 and is conveyed toward the transfer portion on the conveying path 14. Then, the recording sheet conveyed on the conveying path 14 is stopped by being caused to abut against a pressure contact portion of the two resist rolls 20 stopped. Subsequently, an operation of driving the resist rolls 20 is resumed in synchronization with timing with which the toner image is conveyed on the intermediate transfer body 11. The recording sheet is fed to the secondary transfer portion and is electrostatically transferred thereto. The recording sheet, to which the toner image is transferred, is sent to the fixing device 15 and is put in between the heating roll 15*a* and the pressure roll 15*b*. The heating roll 15*a* is heated to a temperature which is high to the extent sufficient to melt the toner image. The toner image is softened between this heating roll 15*a* and the pressure roll 15*b*, and is bonded on the recording sheet by pressure. The recording sheet sent out of the fixing device 15 is conveyed by the conveying roll 24 and the paper discharge roll 25 and is then discharged to the paper discharge tray 16. On the other hand, when an image is formed on both side surfaces of the recording sheet, the gate 17 changes the direction of conveyance of the recording sheet on one of both side surfaces of which an image is formed, so that the recording sheet is sent to the double-sided conveying path 18, and that the direction of conveyance thereof is reversed to thereby sent this recording sheet to the secondary transfer portion again.

Next, the above charging device is described in detail.

Figure 3:
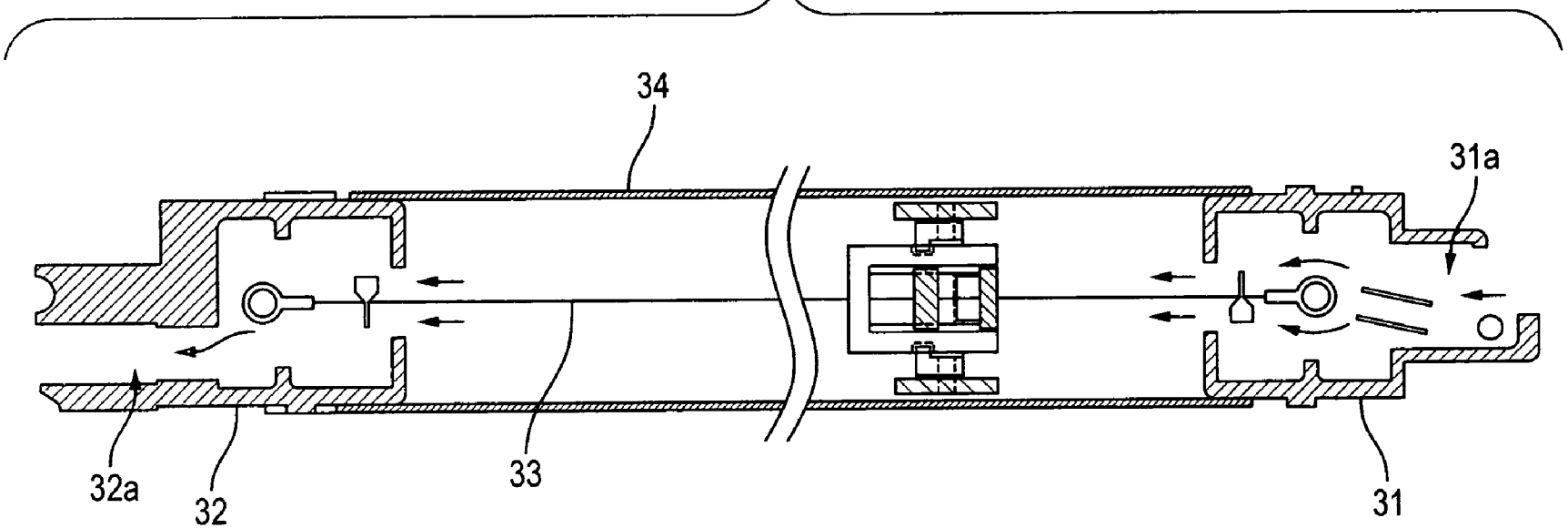
FIG. 3 is a schematic view illustrating the configuration of a charging device used in the image forming apparatus shown in FIG. 1.

As shown in FIG. 3, the charging device 2 has a front end member 31 and a rear end member 32, which are fixed to and supported at a predetermined position with respect to a circumferential surface of the photoreceptor drum 1. An electrode wire 33 which is an example of the charging member is stretched between the front end member 31 and the rear end member 32. The electrode wire 33 is stretched in the direction of width of the endless circumferential surface of the photoreceptor drum 1 and is disposed to face the circumferential surface so that the distance between the circumferential surface and the electrode wire is maintained. Also, a shield case 34, which is an example of the cover member and is supported by both the end members 31 and 32 at both ends, respectively, is provided. The shield case 34 encloses the electrode wire 33 to extend therealong. A part of this shield case, which faces the circumferential surface of the photoreceptor drum, is opened, as illustrated in FIG. 2. A mesh-like grid 35, which is an example of the electric field control member adapted to control an electric field formed by the charging member, is provided at this part that is supported by the end members 31 and 32 at both end portions thereof.

A charging voltage is applied to the electrode wire 33 to form an electric filed between the electrode wire 33 and the photoreceptor drum 1. Also, the grid 35 is set at a potential level between that of the electrode wire 33 and that of the photoreceptor drum 1. The electric field is controlled so that the surface of the photoreceptor drum 1 is charged to a predetermined potential level.

Although the electrode wire 33 is used in the charging device 2 as the charging member, the charging member is not limited to the wire. Thin metal elongated plate-like and bar-like members can be used as the charging member.

Figure 4:
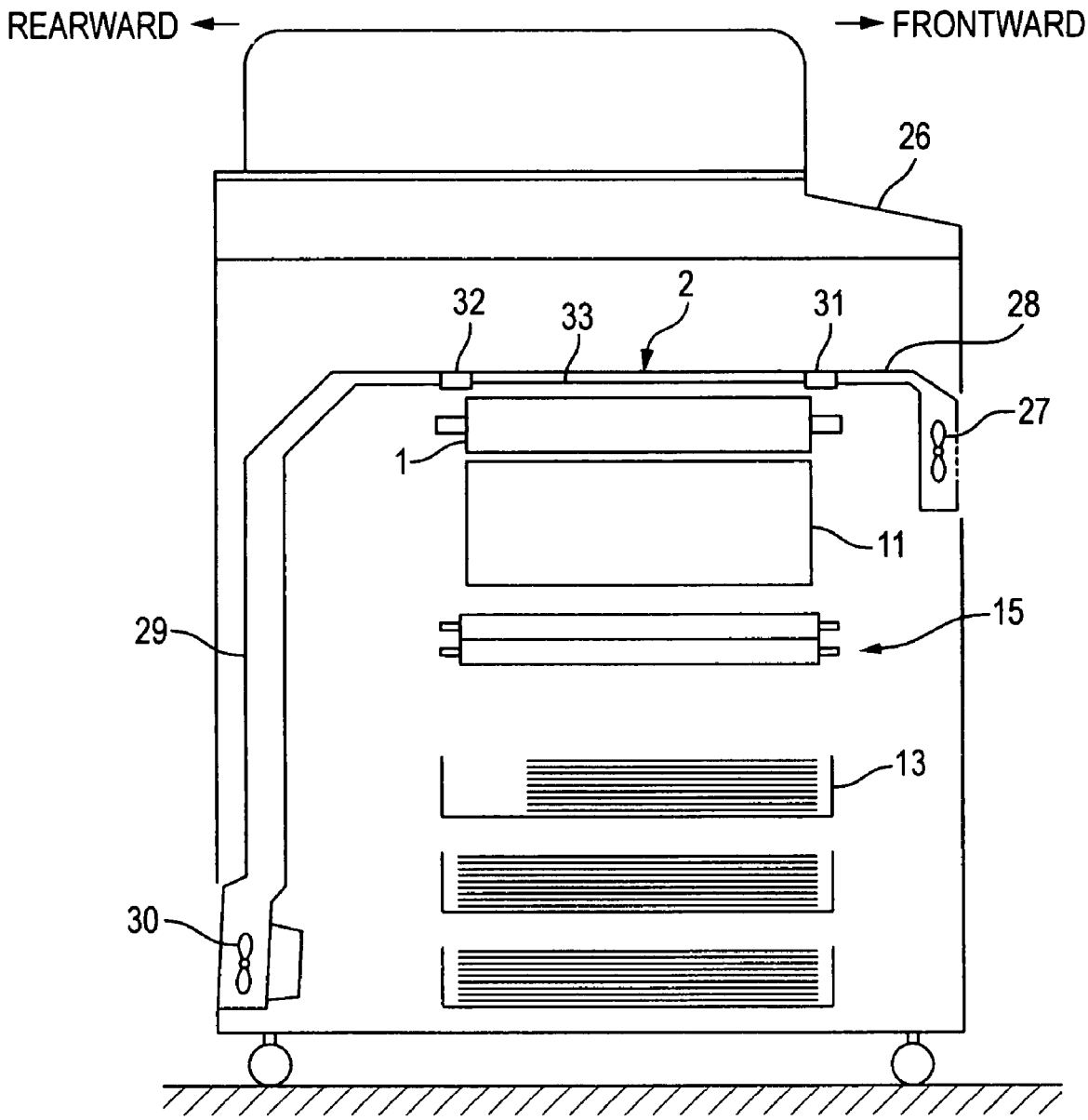
FIG. 4 is a schematic view illustrating an air supply/exhaust unit of the image forming apparatus shown in FIG. 1.

An air supply port 31*a* used to introduce air into a peripheral portion of the electrode wire 33 is provided in the front end member 31. An air exhaust port 32*a* is provided in the rear end member 32. An air introduction path according to the present embodiment is constituted by the air supply port 31*a*, the air exhaust port 32*a* and the shield case 34. As indicated by arrows shown in FIG. 3, an airflow is formed in a region extending from the front end member 31 along the electrode wire 33 in the shield case 34. Air is exhausted from the air exhaust port 32*a* provided in the rear end member 32. As illustrated in FIG. 4, such air supply and exhaust are adapted so that external air is introduced by an air intake fan 27 from the front side, on which an operating panel 26 of the image forming apparatus is provided, and that air is externally exhausted by an air exhaust fan 30 through a front duct 28, the charging device 2, and a rear duct 29. Although the air intake fan 27 and the air exhaust fan 30 may be used exclusively for supply of air to and for exhaust of air from the charging device 2, respectively, it is desired that the air intake fan 27 and the air exhaust fan 30 can be used for supply of air to and for exhaust of air from another part of the image forming apparatus.

As illustrated in FIGS. 3, 5, 6, and 7, the charging device 2 has a cleaning unit configured to clean the electrode wire 33 and the grid 35. The cleaning unit includes a support body 36 that is an example of the support member configured to move along the direction of the axis line of the electrode wire 33, a first pad 37 configured to be supported by the support body 36 and put into contact with the electrode wire 33 from the side opposite to the photoreceptor drum 1, that is, from the rear surface side, a second pad 38 configured to be put into contact with the electrode wire 33 from the side of the photoreceptor drum 1, a brush 39 provided to be in contact with the grid 35, and a movement member 40 fit into the support body 36 to cause the first pad 37 to operate to be put into contact with or separated from the electrode wire 33. The first pad 37 and the second pad 38 function as the cleaning member for the electrode wire 33. The brush 39 functions as the cleaning member for the grid 35. A screw member 41, which has both ends respectively supported by the front end member 31 and the rear end member 32, and which is driven to rotate around an axis line thereof, is provided so as to move this cleaning member in the direction of the axis line of the electrode wire 33.

The screw member 41 is such that a spiral projection portion is provided on a circumferential surface of a bar-like metal member. The screw member 41 is supported in parallel to the axis line of the electrode wire 33, and is screwed into and penetrates through a threaded screw hole provided in a drive transmission portion 36*a* of the support body 36. Therefore, a driving force in the direction of the axis line is applied to the support body 36 by rotationally driving the screw member 41 around the axis line thereof.

The support body 36 includes a base portion 36*b* which is disposed inside the shield case 34 and supports the pads 37 and 38 and the brush 39, and also includes the drive transmission portion 36*a* outwardly projecting from the base portion 36*b* through a slit provided in the shield case 34. The base portion 36*b* has a shape surrounding a side-surface side and a rear-surface side of the electrode wire 33 with respect to a circumferential surface of the photoreceptor drum 1. The support body 36 is supported by the screw member 41 penetrating through the drive transmission portion 36*a* and an edge portion 34*a* of the slit formed in the shield case 34 and is driven in the direction of the axis line of the electrode wire 33 by the rotation drive of the screw member 41.

The first pad 37 is attached to an end of an arm 42 rotationally movably provided at the support body 36. This arm 42 is pushed against the electrode wire 33 from the rear surface side by rotating a predetermined angle around a support shaft extending in a direction perpendicular to the electrode wire 33. This arm 42 is separated from the electrode wire 33 by rotating in the opposite direction. The second pad 38 is attached to the beam-like member 43 provided between the electrode wire 33 and the photoreceptor drum 1, and is fixed in position with respect to the support body 36. When the first pad 37 is not in contact with the electrode wire 33, the second pad 38 faces the electrode wire 33 from the side of the photoreceptor drum 1 and is supported at a position slightly distant from the electrode wire 33. On the other hand, when the first pad 37 is pushed against the electrode wire 33, the electrode wire 33 is displaced and pushed against the second pad 38.

Figure 7:
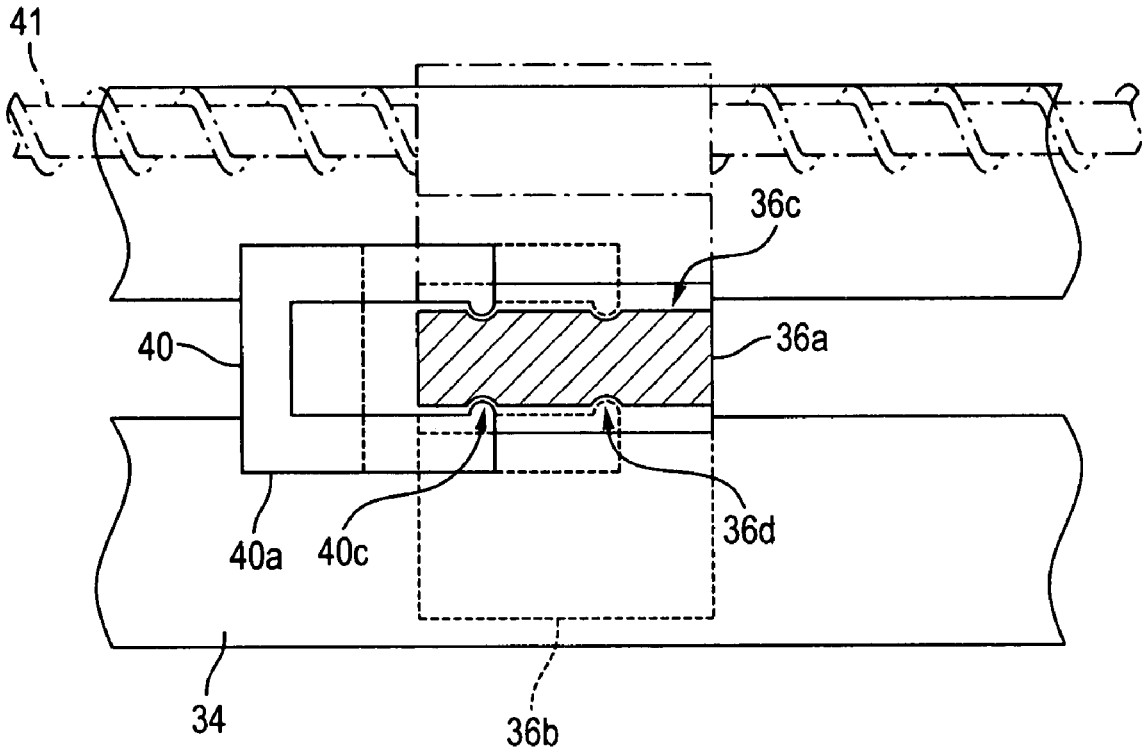
FIG. 7 is a cross-sectional view, taken on line C-C shown in FIG. 6, illustrating the structure of the charging device used in the image forming apparatus shown in FIG. 1 and that of a cleaning unit equipped in the charging device.

The movement member 40 is fit to the support body 36 from the rear side of the image forming apparatus. Paired projection portions 40*a* projecting frontwardly from a part distant from the photoreceptor drum 1 are fit into grooves 36*c* provided in the drive transmission portion 36*a* of the support body 36. As illustrated in FIG. 7, the paired projection portions 40*a* are connected to each other to sandwich the drive transmission portion 36*a*. An arm drive portion 40*b* protrudes frontwardly from a part close to the photoreceptor drum 1 and is put into contact with a photoreceptor-drum-side part of the arm 42 supporting the first pad 37. This movement member 40 can perform relative displacement in the direction of the axis line of the electrode wire 33 with respect to the support body 36. That is, the movement member 40 can move between a position (indicated by dashed lines shown in FIG. 7), in which the movement member 40 is deeply and frontwardly fit into the support body 36, and a position in which the movement member 40 is rearwardly drawn. A projection 40*c* provided at an end of the projection portion 40*a* is fit into a concave portion 36*d* provided in the groove 36*c* of the drive transmission portion 36*a* in each of the positions. The projection 40*c* is caught therein so that the projection 40*c* can be separated from the concave portion 36*d* when a strong force acts thereon. Thus, the projection 40*c* has what is called a latch function.

The above movement member 40 performs relative movement with respect to the support body 36 to thereby rotate the arm 42. Thus, an operation of bringing the first pad 37 away from or closer to the electrode wire 33 is performed. Consequently, the movement member 40 functions as a position regulation member according to the present embodiment. That is, in the position in which the movement member 40 is deeply fit into the support body 36, the arm drive portion 40*b* is in contact with the arm 42, so that the arm 42 pushed by a spring 44 toward the electrode wire is pushed back to the position in which the first pad 37 is separated from the electrode 33. In the position in which the movement member 40 is rearwardly drawn out of the support body 36, the arm-drive portion 40*b* retreats from the arm 42. The first pad 37 is pushed against the electrode wire 33 by a pushing force of the spring 44, which is applied to the arm 42. Thus, the electrode wire 33 is displaced to the circumferential surface side of the photoreceptor drum 1 and is pushed against the second pad 38 fixed in position to the support body 36, so that the first pad 37 and the second pad 38 are pushed from both the rear side and the front side of the photoreceptor drum.

The relative movement of the movement member 40 with respect to the support body 36, and the operation of bringing the first pad 37 closer to and away from the electrode wire 33 are performed in association with driving of the support body 36 in the direction of the axis line of the electrode wire 33.

Figure 5:
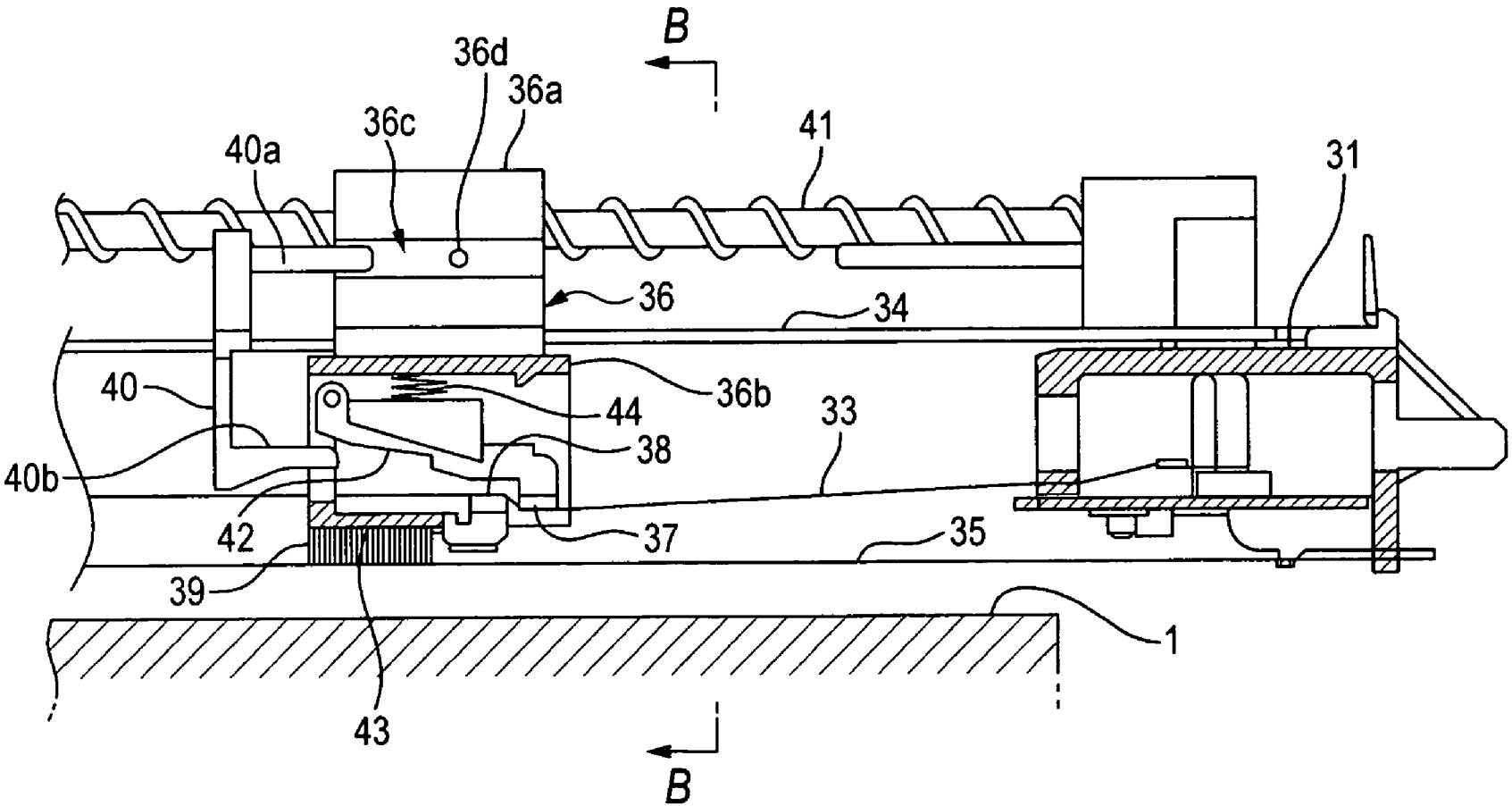
FIG. 5 is a cross-sectional view, taken on line A-A shown in FIG. 6, illustrating the structure of the charging device used in the image forming apparatus shown in FIG. 1 and that of a cleaning unit equipped in the charging device.
Figure 8A:
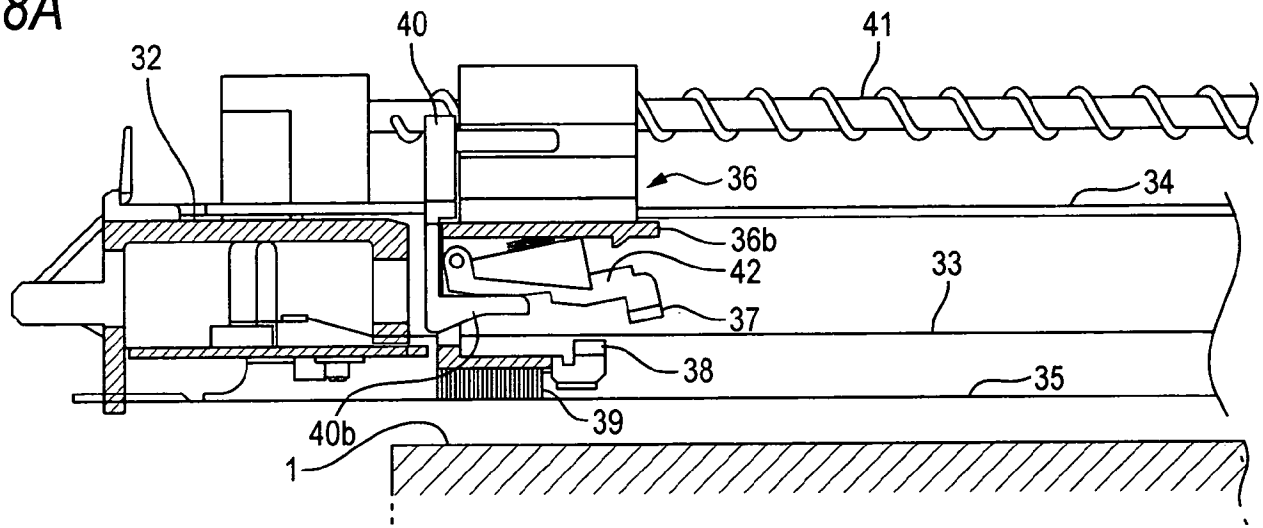
FIGS. 8A and 8B are cross-sectional views illustrating an operation of the charging device shown in FIGS. 5 to 7.

When the support body 36 moves from the front side to the rear side, the movement member 40 moves in a state in which the movement member 40 is projected from the support body 36 toward the rear side, as illustrated in FIG. 5. At that time, the first pad 37 and the second pad 38 are in contact with the electrode wire 33. Then, when the support body 36 approaches the rear end member 32, the movement member 40 projected rearwardly abuts against the rear end member 32 and is pushed into the front side of the support body 36, as illustrated in FIG. 8A. Thus, the arm drive portion 40*b* projected frontwardly is in contact with the arm 42 and is rotated in a direction, in which the arm drive portion 40*b* is away from the photoreceptor drum 1, to thereby separate the first pad 37 from the electrode wire 33. Consequently, the electrode wire 33 is displaced in a direction, in which the electrode wire 33 is separated by a tensile force thereof from the photoreceptor drum 1, so that the electrode wire 33 is also separated from the second pad 38.

Figure 8B:
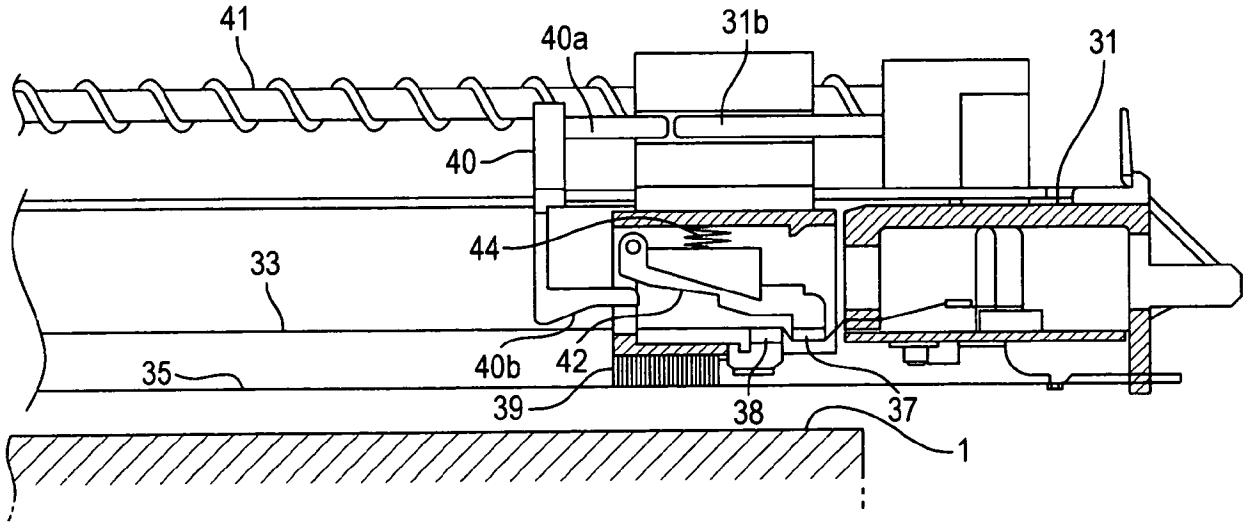

In a state in which the first pad 37 and the second pad 38 are separated from the electrode wire 33, as described above, the support body 36 moves frontwardly so that the support body 36 approaches the front end member 31. In the front end member 31, as illustrated in FIG. 8B, an extrusion member 31*b* projected to a position corresponding to the projection portion 40*a* of the movement member 40 is provided. When the support body 36 approaches the front end member 31, the extrusion member 31*b* abuts against the projection portion 40*a* of the movement member 40 to push out the movement member 40 rearwardly from the support body 36. Thus, the arm drive portion 40*b* is pulled out backwardly. The arm 42 is pushed against the photoreceptor drum 1 by the pushing force of the spring 44. Consequently, the first pad 37 and the second pad 38 are pushed against the electrode wire 33 again. Subsequently, when the support body 36 rearwardly moves, the movement member 40 moves in a state in which the movement member 40 is backwardly pushed with respect to the support body 36.

Therefore, when the support body 36 moves from the front side to the rear side, the support body 36 moves in a state in which the first pad 37 and the second pad 38 are pushed against the electrode wire 33. Thus, the cleaning of the electrode wire 33 is performed. Then, when the support body 36 moves from the rear side to the front side, the first pad 37 and the second pad 38 are separated from the electrode wire 33. Thus, the support body 36 moves without cleaning the cleaning of the electrode wire 33.

An air supply/exhaust unit forms an airflow in the peripheral portion of the electrode wire 33 from the front side to the rear side when the cleaning unit is driven, for the charging device 2 having the cleaning unit driven in the above manner. Therefore, the support body 36 moves from the front side to the rear side, the support body 36 moves from the upstream side to the downstream side of the airflow. The first pad 37 and the second pad 38 perform the cleaning of the electrode wire 33 and remove foreign matters from the electrode wire 33. The removed foreign matters are rearwardly conveyed. Also, particles of the foreign matters, which are dispersed from the electrode wire 33 as the pads move, are quickly drifted to the downstream side and are excluded without being made to adhering to the electrode wire 33. When the support body 36 moves from the rear side to the front side, the support body 36 moves in a state in which the first pad 37 and the second pad 38 are separated from the electrode wire 33. Thus, no matters adhering to the electrode wire 33 are dispersed from the electrode wire 33.

In a case where the cleaning by driving the support body 36 is performed, that is, at the standby of the cleaning unit, for example, at the time of charging the circumferential surface of the photoreceptor drum 1, the support body 36 stands ready at the downstream side of the airflow, that is, the rear side. Accordingly, the movement member 40 is pushed into the front side portion of the support body 36. The first pad 37 and the second pad 38 are separated from the electrode wire 33. Consequently, foreign maters can be prevented from being dispersed from the pads and adhering again to the electrode wire 33.

On the other hand, the brush 39 attached to the support body 36 is in contact with the grid 35 at both moments at which the support body 36 moves from the front side to the rear side, and which the support body 36 moves from the rear side to the front side. As the support body 36 moves, the cleaning of the grid 35 is performed. Additionally, the brush 39 for cleaning the grid 35 can be configured to be in contact with the grid 35 only when the support body 36 moves from the front side to the rear side.

The present embodiment can employ, for example, the following configuration.

Figure 9A:
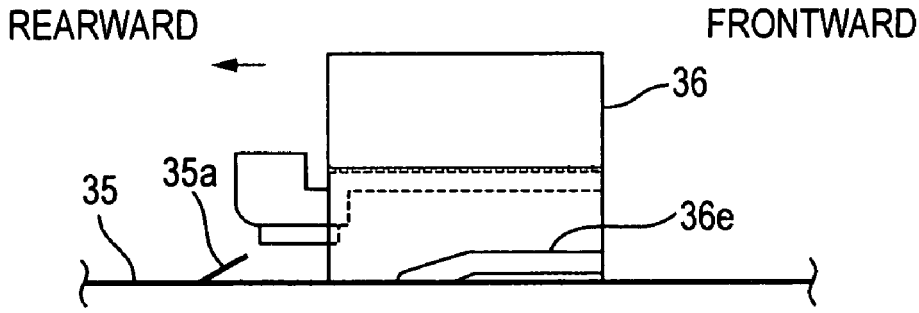
FIGS. 9A to 9E are schematic views illustrating a grid cleaning mechanism that can be employed by the charging device shown in FIGS. 5 to 7.
Figure 9B:
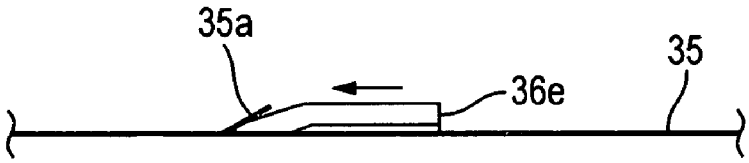
Figure 9C:
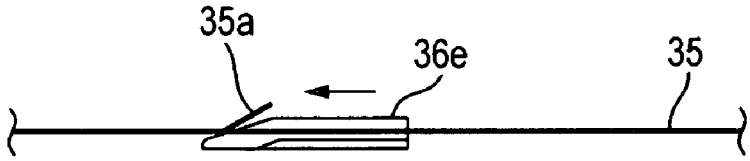
Figure 9D:
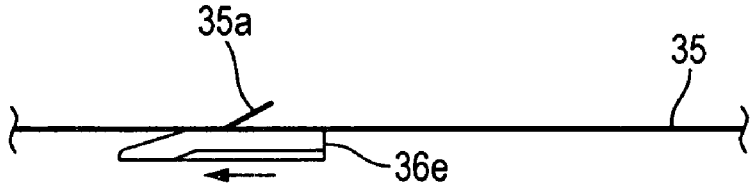
Figure 9E:
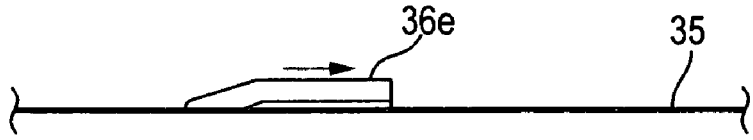
Figure 10:
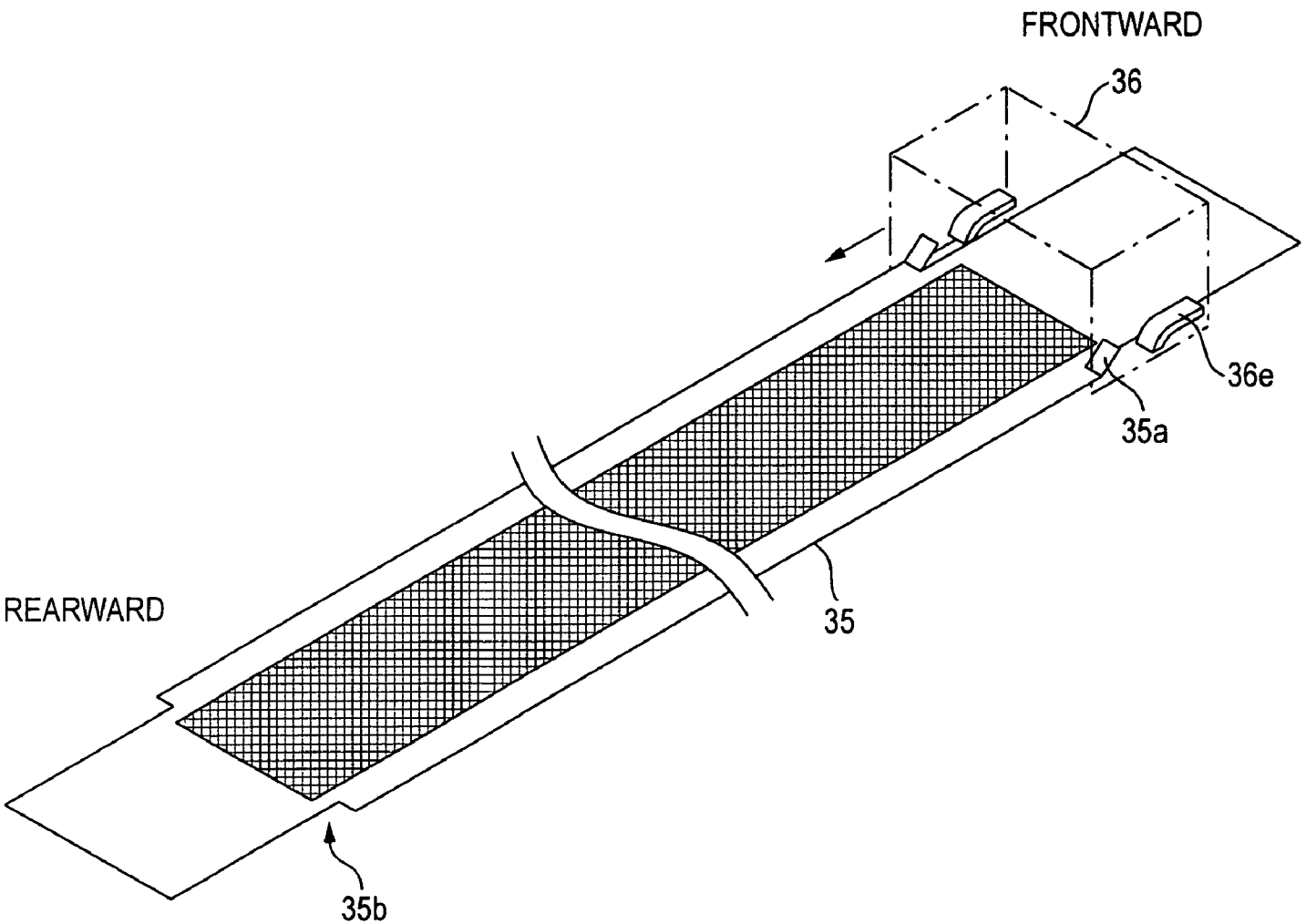
FIG. 10 is a schematic perspective view illustrating the grid cleaning mechanism shown in FIGS. 9A and 9B.

As illustrated in FIGS. 9A to 9E and 10, a holding member 36*e* projected from the support member 36 to be in contact with both side edges of the grid 35 is provided. The support member 36 is made to be in contact with the brush 39 to cause the holding member 36*e* to hold the side edge portions of the grid 35. That is, the holding member 36*e* is provided at a position farther from the photoreceptor drum 1 than the position from which the grid 35 is stretched. When the support body 36 moves from the front side to the rear side, a tipped-up portion 35*a* provided in a widened part of the side edge of the grid 35, as illustrated in FIGS. 9B, 9C, and 9D, causes the holding member 36*e* to turn to the side of the photoreceptor drum 1. Thus, the grid 35 is attracted to the side of the brush 39, and is in contact therewith. Then, at the position close to the rear end member 32, the cleaning of the grid 35 is performed. The holding of the grid 35 by the holding member 36*e* is released at a portion 35*b*, at which the width of the grid 35 is decreased, as illustrated in FIG. 10. Then, when the support body 36 moves from the rear side to the front side, the holding member 36*e* is not turned toward the photoreceptor drum 1 of the grid 35, as illustrated in FIG. 9E. Thus, the grid 35 is put into a state in which the grid 35 is separated from the brush 39. With this configuration, the holding member 36*e* functions as a member adapted to regulate the position of the grid 35 with respect to the brush 39. The apparatus can be adapted so that the cleaning of the gird 35 is performed only when the brush 39 moves from the upstream side to the downstream side of the airflow.

According to the present embodiment, the positions of the brush 39 and the grid 35 are regulated by regulating the position of the grid 35 with respect to the brush 39. However, the present embodiment can be modified so that the position of the brush with respect to the grid 35 is regulated.

The above cleaning unit can be set to be driven, for example, when the power for the image forming apparatus is turned on, before an image forming operation is started, or when the image forming operation is finished. Further, the image forming apparatus can be set so that the cleaning unit is driven every time a predetermined number of images are formed. Additionally, it is desirable that the airflow of the air supply/exhaust unit is controlled to be generated at least when the cleaning unit is driven, that the cleaning unit stands ready at the downstream side of the air flow, and that when the circumferential surface of the photoreceptor drum is charged, an airflow is generated to quickly eliminate a discharge product.

Next, a second embodiment of the charging device according to the invention, which can be used in the image forming apparatus shown in FIG. 1, is described below.

Figure 11A:
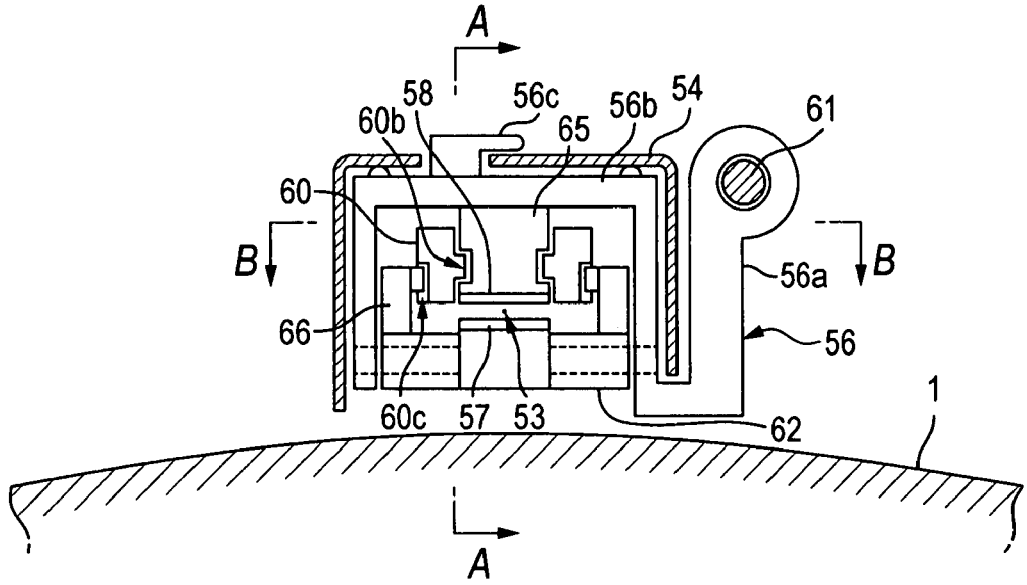
FIGS. 11A and 11B are cross-sectional views illustrating a charging device according to another embodiment, that is, a second embodiment of the invention, which can be used in the image forming apparatus shown in FIG. 1.
Figure 11B:
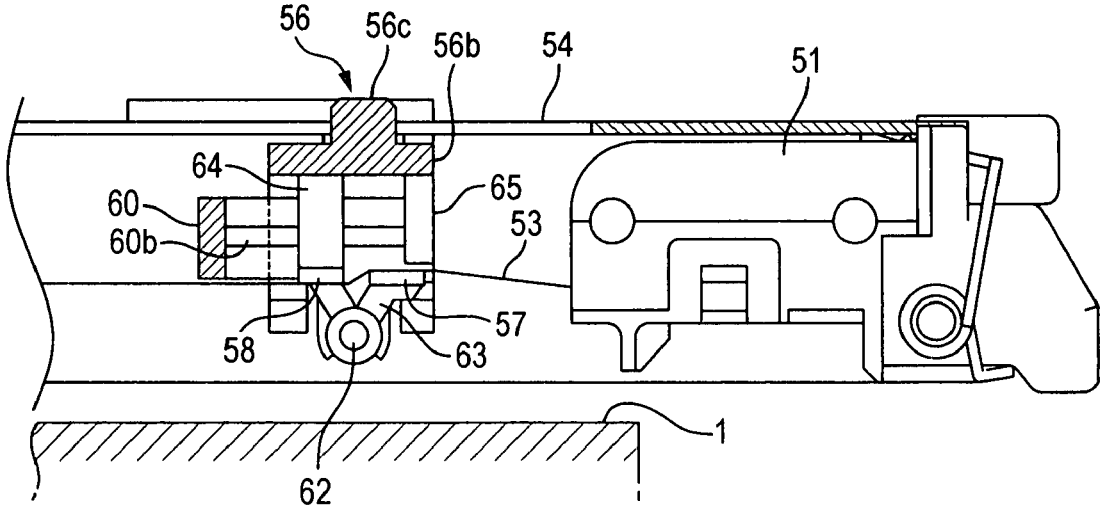
Figure 12:
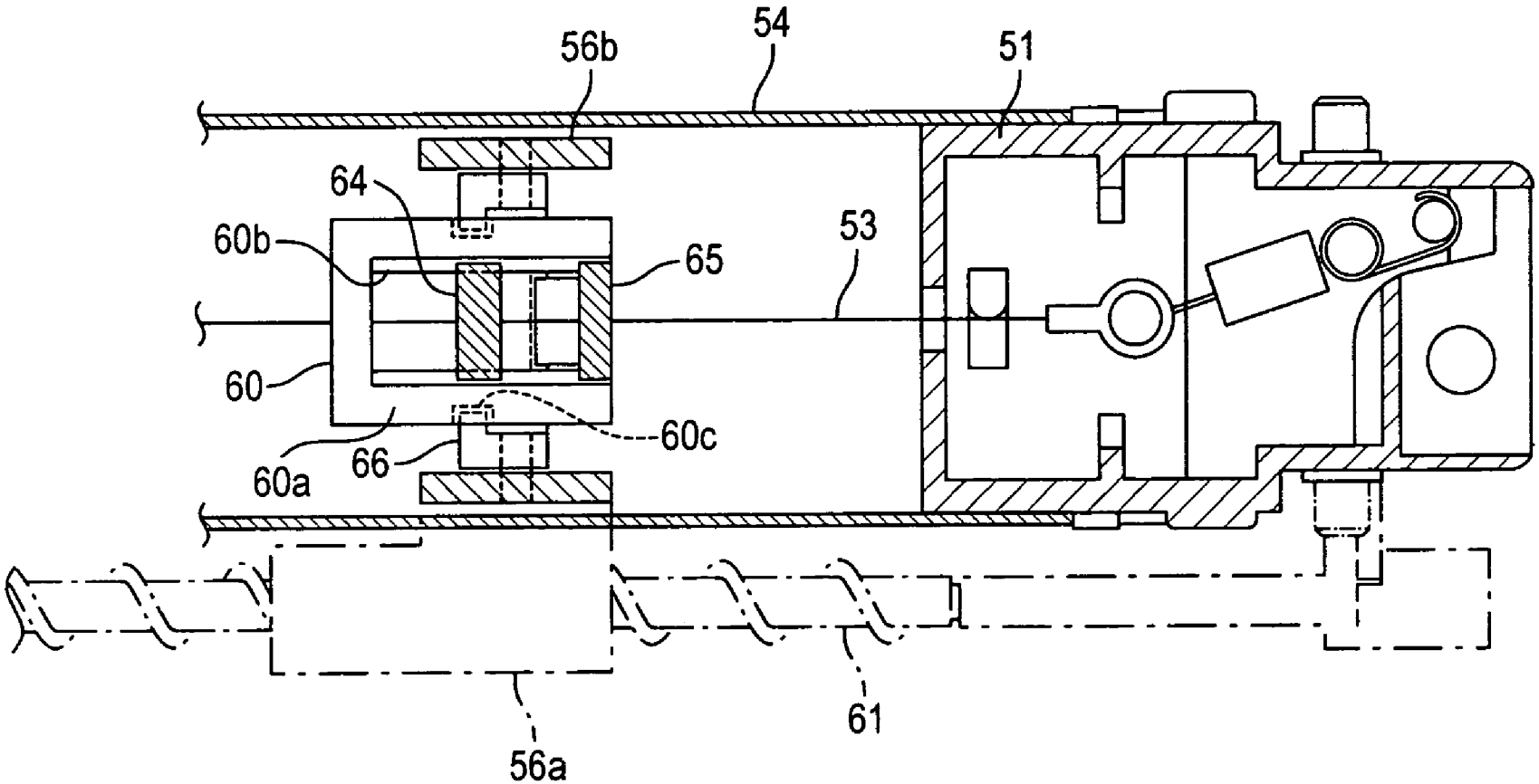
FIG. 12 is a cross-sectional view, taken on line B-B shown in FIG. 11, illustrating the charging device shown in FIG. 11.

FIGS. 11A and 11B are cross-sectional views illustrating this charging device which can be used in the image forming apparatus according to the second embodiment of the invention. FIG. 11A illustrates a cross-section of the charging device, which is taken in a direction perpendicular to the axis line of the electrode wire stretched in the direction of width of the circumferential surface of the photoreceptor drum 1. FIG. 11B illustrates a cross-section of the charging device, which is taken in a direction parallel to the axis line of the electrode wire, that is, taken on line A-A in FIG. 11A. FIG. 12 illustrates a cross-section of the charging device taken on line B-B in FIG. 11A.

Figure 6:
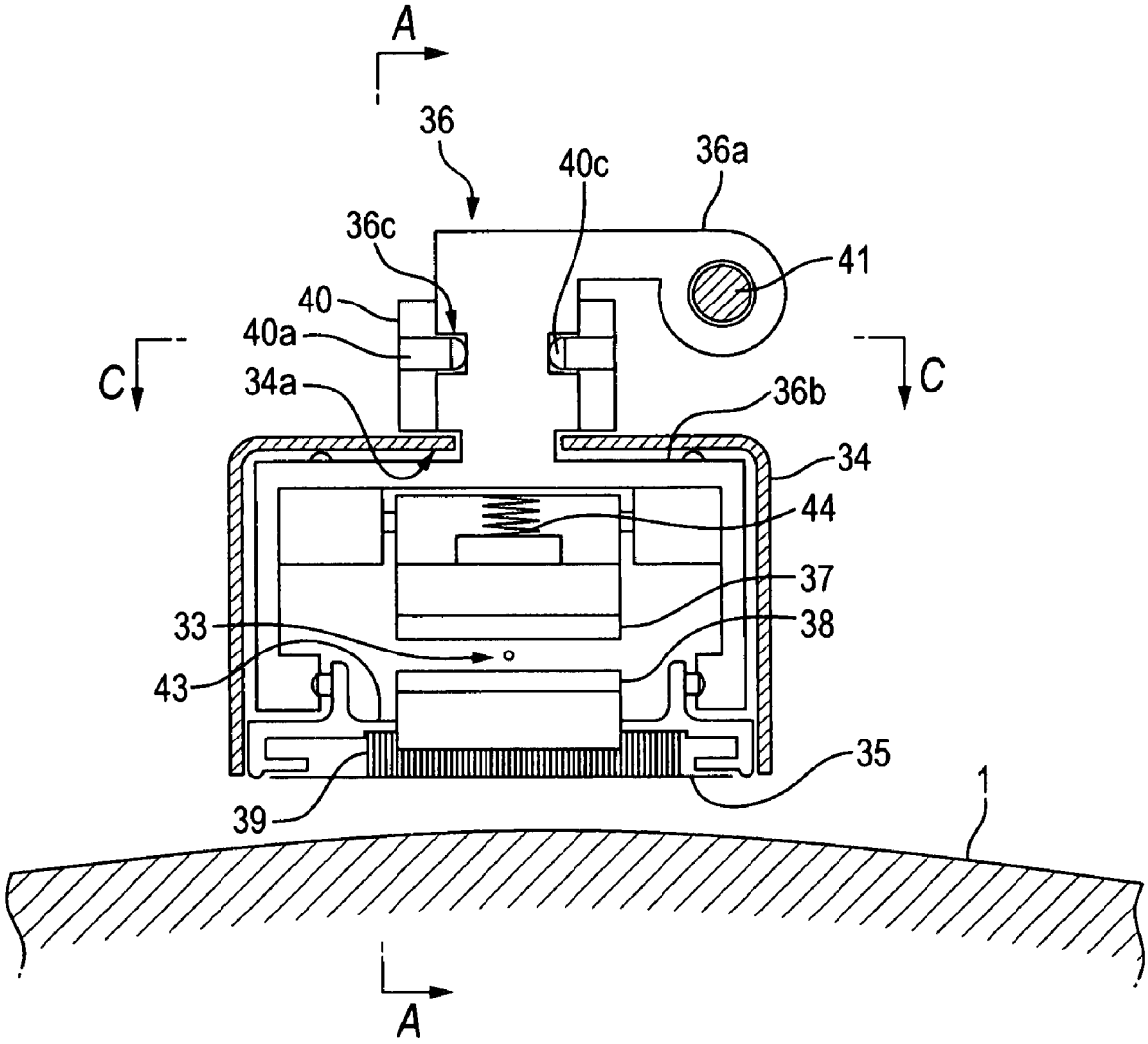
FIG. 6 is a cross-sectional view, taken on line B-B shown in FIG. 5, illustrating the structure of the charging device used in the image forming apparatus shown in FIG. 1 and that of a cleaning unit equipped in the charging device.

This charging device has a front end member 51 and a rear end member 52, which are fixed and supported, an electrode wire 53 stretched therebetween, a shield case 54 provided to surround the region surrounding the electrode wire 53, and a cleaning unit for the electrode wire 53, similarly to the charging devices shown in FIGS. 5, 6, and 7.

This cleaning unit has a support body 56 configured to move in the direction of the axis line of the electrode wire, a first pad 57 supported by the support body 56 and to be in contact with the electrode wire 53 from the photoreceptor drum side, a second pad 58 configured to be in contact with the electrode wire from the rear surface side of the photoreceptor drum 1, and a movement member 60 configured to drive the first pad 57 to be in contact with or separated from the electrode wire 53. Also, a screw member 61 configured to drive the cleaning unit in the direction of the axis line of the electrode wire 53 is supported in parallel to the electrode wire 53 outside the shield case 54. The screw member 61 has a configuration similar to that of the charging device shown in FIG. 5 and is supported by the front end member 51 and the rear end member 52 at both ends thereof, respectively, and is rotationally driven around the axis line.

The above support body 56 includes a base portion 56*b* disposed inside the shield case 54, which supports the pad, and a drive transmission portion 56*a* which is continuously connected to the base portion 56*b* and extends outwardly from a region surrounded by the shield case 54 from between the photoreceptor drum 1 and the shield case 54. The support body 56 is supported by the screw member 61, which penetrates through the drive transmission portion 56*a*, and the projection portion 56*c* caught in the edge of the slit provided in the shield case 54. The support body 56 is driven in the direction of the axis line of the electrode wire 53 by rotationally driving the screw member 61.

The first pad 57 is attached to a first arm 63 protruded from a support shaft 62 rotatably provided on the support body 56. When the support shaft 62 is rotated within a predetermined range, the first pad 57 is pushed against the electrode wire 53 from the side of the photoreceptor drum 1. When the support shaft 62 is rotated in the opposite direction, the first pad 57 is separated from the electrode wire 53. The second pad 58 is attached to an end of a rear columnar portion 64 projected toward the electrode wire 53 from the rear surface side of the support body 56, and is fixed in position to the support body 56. Additionally, when the first pad 57 is not in contact with the electrode wire 53, the second pad 58 is supported at a position slightly distant from the electrode wire 53 to face the electrode wire 53. The electrode wire 53 is displaced by pushing the first pad 57 thereagainst. Thus, the electrode wire 53 is pushed against the second pad 58.

Figure 13A:
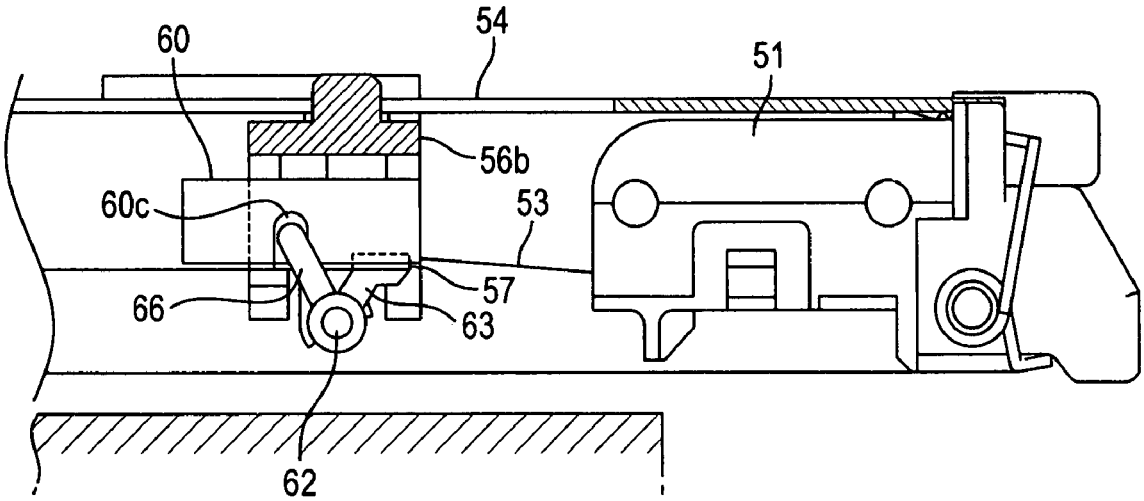
FIGS. 13A and 13B are cross-sectional views illustrating an operation of the charging device shown in FIGS. 11A to 12.

The movement member 60 is relatively displaceably connected to the support body 56 by thrusting a pair of parallel projection portions 60*a* thereinto from the rear side of the support body 56, as illustrated in FIG. 12. That is, the movement member 60 is connected to the support body 56 by fitting a rail-like convex portion 60*b* provided on the projection portion 60*a* into a groove-like concave portion provided in each of the rear columnar portion 64 and the front columnar portion 65 protruding from the rear surface of the support body 56. Further, the convex portion 60*b* slides in each of the groove-like concave portions to thereby enable the movement member 60 to move with respect to the support body 56 in an anteroposterior direction, that is, the direction of the axis line of the electrode wire 33. The movement member 60 functions as the position regulating member. Concave depression portions 60*c* are provided in both side surfaces of the movement member 60, respectively, as illustrated in FIG. 13A. A catching projection of the second arm 66 protruding from the support shaft 62 is fit into the concave depression portion 60*c*. Then, the movement member 60 moves with respect to the support body 56 to thereby cause the support shaft 62 a predetermined angle. Accordingly, the movement member 60 moves with respect to the support body 56. Thus, the support shaft 62 is rotated. The first arm 63 fixed to the movement member 62 rotates, so that the first pad 57 is pushed against or separated from the electrode wire 53.

In such a charging device, when the support body 56 moves from the front side to the rear side, that is, from the upstream side to the downstream side of the airflow formed in the region surrounding the electrode wire 53, the movement member 60 protrudes rearwardly, as illustrated in FIG. 13A. Further, the first pad 57 is pushed against the electrode wire 53. Thus, the second pad 58 is pushed against the electrode wire 53.

Figure 13B:
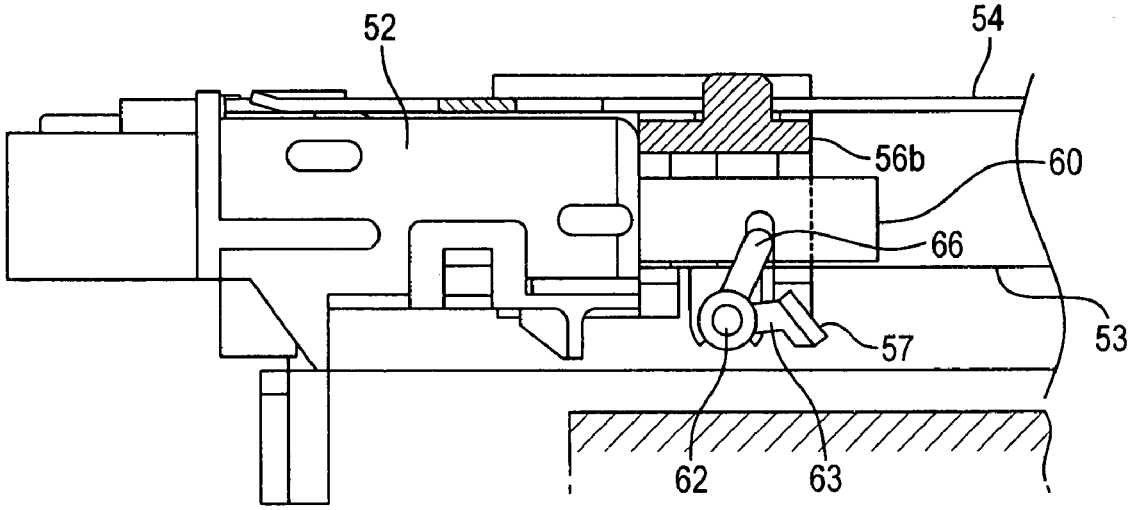
Figure 14:
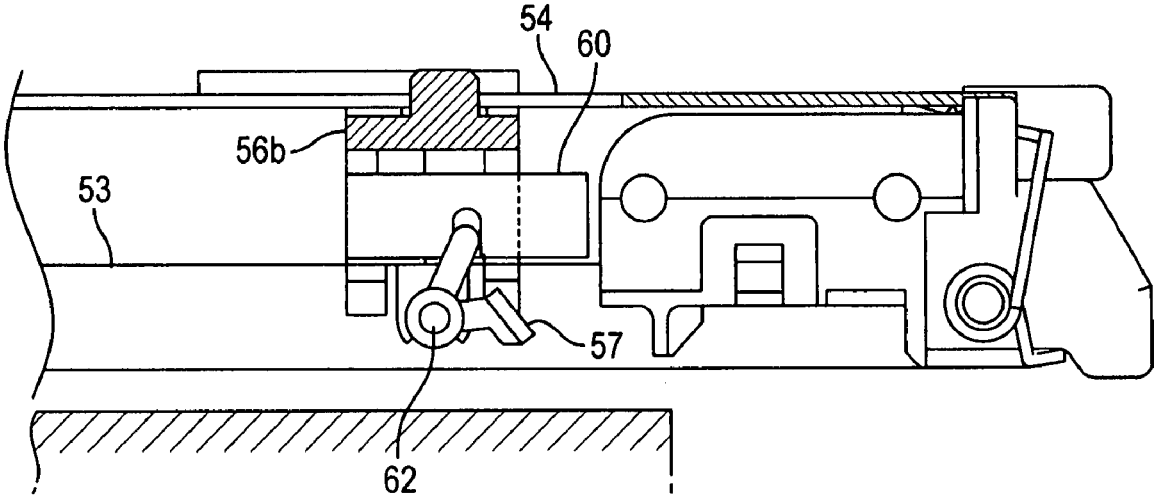
FIG. 14 is a cross-sectional view illustrating an operation of the charging device shown in FIGS. 11A to 12.

When the support body 56 approaches the rear end member 52, the movement member 60 is made to abut against the rear end member 52. As illustrated in FIG. 13B, the movement member 60 is pushed out to the front side of the support body 56. Consequently, the support shaft 62 rotates, so that the first pad 57 retreats from the electrode wire 53, and that the electrode wire 53 is separated from the second pad 58. When the movement member 60 moves to the front side, that is, to the upstream side of the airflow in this state, and the movement member 60 approaches the front end member 53 and is pushed out to the rear side, as shown in FIG. 14, the first pad 57 is pushed against the electrode wire 53 again, and additionally, the second pad 58 is pushed against the electrode wire 53 again.

Figure 15A:
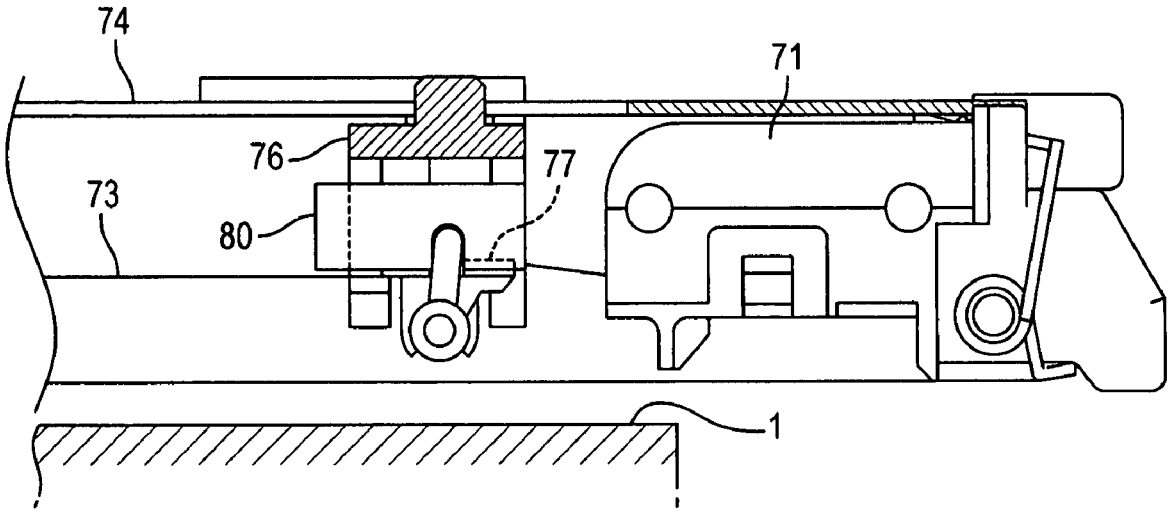
FIGS. 15A and 15B are cross-sectional views illustrating a charging device according to another embodiment, that is, a third embodiment of the invention, which can be used in the image forming apparatus shown in FIG. 1.
Figure 15B:
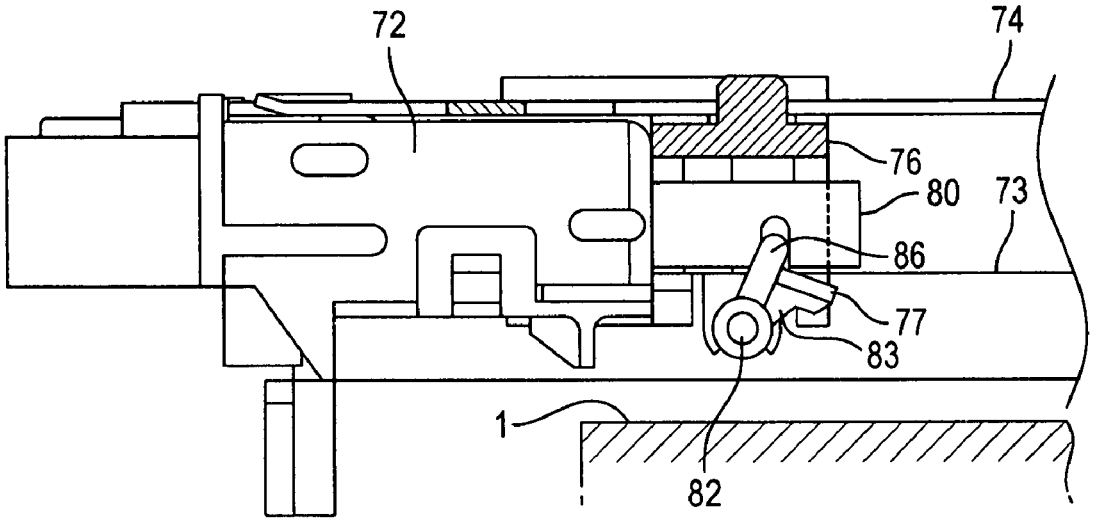

FIGS. 15A and 15B are cross-sectional view illustrating a third embodiment of the charging apparatus according to the invention.

This charging device has end members 71 and 72, an electrode wire 73, a shield case 74, a screw member (not shown), and a cleaning unit, similarly to the charging device shown in FIGS. 11A to 14. Similarly, the cleaning unit has a support member 76, a first pad 77, a second pad (not shown), and a movement member 80. Incidentally, in this changing device differing from the charging device shown in FIGS. 11A and 11B in the length of a part of the movement member 80, which is projected from the support member 76, and in the mounting angle of each of a first arm 83 and a second arm 86 fixed to a support shaft 82.

In the charging device according to the third embodiment, as shown in FIG. 15A, in a state in which the movement member 80 is protruded rearwardly from the support member 76, the first pad 77 is pushed against the electrode wire 73. Also, the support member 76 moves together with the first pad 77 and the second pad (not shown) to thereby perform the cleaning of the electrode wire 73. Then, as shown in FIG. 15B, the movement member 80 is made to abut against the rear end portion 72. When the movement member 80 is pushed into the support member 76 to the front side, the support shaft 82 rotates, and the first pad 77 retreats from the electrode wire 73. The movement member 80 operates the first pad 77 in this manner and serves as the position regulating member according to the present embodiment. According to the present embodiment, when the first pad 77 retreats from the electrode wire 73, the first pad 77 is not completely separated from the electrode wire 73. The first pad 77 is pushed against the electrode wire 73 by a force weaker than the force acting when the support member 76 moves from the front side to the rear side. In such a state, the support member 76 moves from the rear side to the front side, that is, from the downstream side to the upstream side of the airflow. At that time, the contact pressure of each of the first pad 77 and the second pad (not shown) to the electrode wire 73 is reduced. Thus, foreign matters adhering to the electrode wire 73 are not flaked off. However, the foreign matters can be put into a state in which the foreign matters are easily flaked off. Consequently, when the first pad 77 and the second pad (not shown) move from the downstream side to the upstream side of the airflow, it is little likely that particles of foreign matters are dispersed. Then, the movement member 80 is made to abut against the end member 71 provided at the upstream side. After the first pad 77 and the second pad (not shown are made to strongly abut against the electrode wire 73, when the first pad 77 and the second pad (not shown) move together with the support member 76 from the upstream side to the downstream side, the foreign matters adhering to the electrode wire 73 are easily flaked off and are efficiently removed therefrom.

Figure 16A:
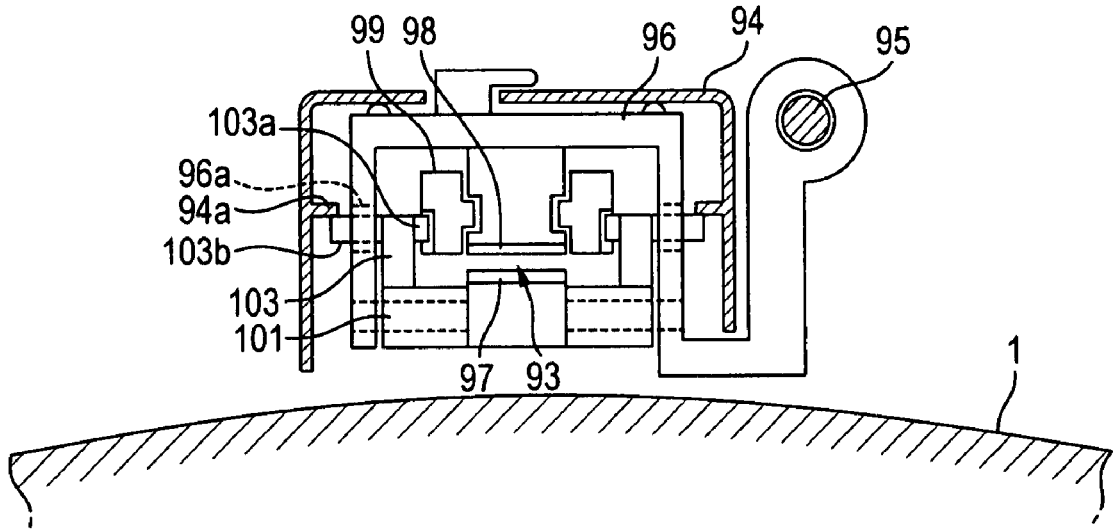
FIGS. 16A and 16B are cross-sectional views illustrating a charging device according to another embodiment, that is, a fourth embodiment of the invention, which can be used in the image forming apparatus shown in FIG. 1.
Figure 16B:
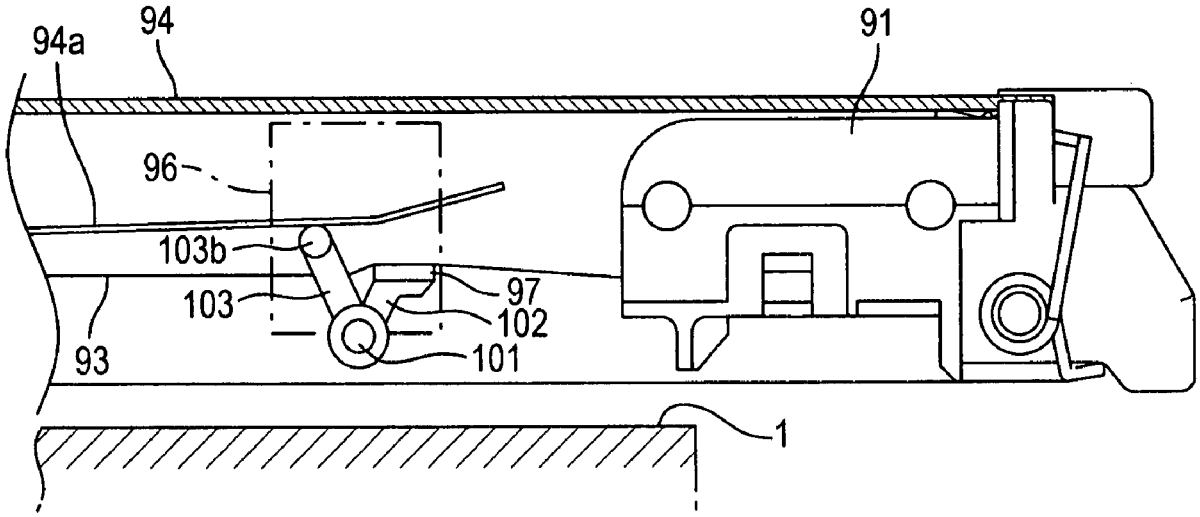

FIGS. 16A and 16B are a cross-sectional view illustrating a fourth embodiment of the charging device according to the invention, and a schematic view illustrating a mechanism configured to control the contact pressure of each of the pads to the electrode wire.

This charging device has an end member 91, an electrode wire 93, a shield case 94, a screw member 95, and a cleaning unit, similarly to the charging device shown in FIGS. 11A to 14. Similarly, the cleaning unit has a support member 96, a first pad 97, a second pad 98, and a movement member 99. Incidentally, in this charging device according to the fourth embodiment, a guide member 94*a*, which is an example of the guide member, is provided along the direction of the electrode wire 93 inside a side surface portion of the shield case 94. This guide member 94*a* is provided by being inclined so as to gradually approach the photoreceptor drum 1 from the front side to the rear side. On the other hand, at an end portion of a second arm 103 protruding from the support shaft 101, an outer projection 103*b* projecting to the opposite side is provided in addition to a projection 103*a* to be fit to the movement member 99. This outer projection 103*b* projects from a through-hole 96*a* provided in a side portion of the support body 96 and is in contact with a photoreceptor-drum-side surface of the guide member 94*a*. Therefore, when the support body 96 moves from the front side to the rear side in a state in which the first pad 97 is in contact with the electrode wire 93, as illustrated in FIG. 16B, the guide member 94*a* regulates the position of the outer projection 103*b*. Thus, the outer projection 103*b* is gradually pushed to the photoreceptor drum side. Consequently, the support shaft 101 is gradually rotated, so that a force of pushing the first pad 97 attached to the first arm 102 against the electrode wire 93 increases. The guide member 94*a* is not provided in the vicinity of each of the front end member and the rear end member. Thus, the restriction of the outer projection 103*b* is released. Accordingly, when the support body 96 approaches the end member 91, so that the movement member 99 is made to abut against the end member, the second arm 103 revolves to thereby perform the separation of the first pad 97 from the electrode wire 93, or the contact of the first pad 97 with the electrode wire 93, similarly to the charging device shown in FIGS. 11A to 14. Further, when the first pad 97 is separated from the electrode wire 93, the first pad 97 and the second pad 98 move to the front side in a state in which the first pad 97 and the second pad 98 are separated from the electrode wire 93, similarly to the charging device shown in FIGS. 11A to 14.

Figure 17A:
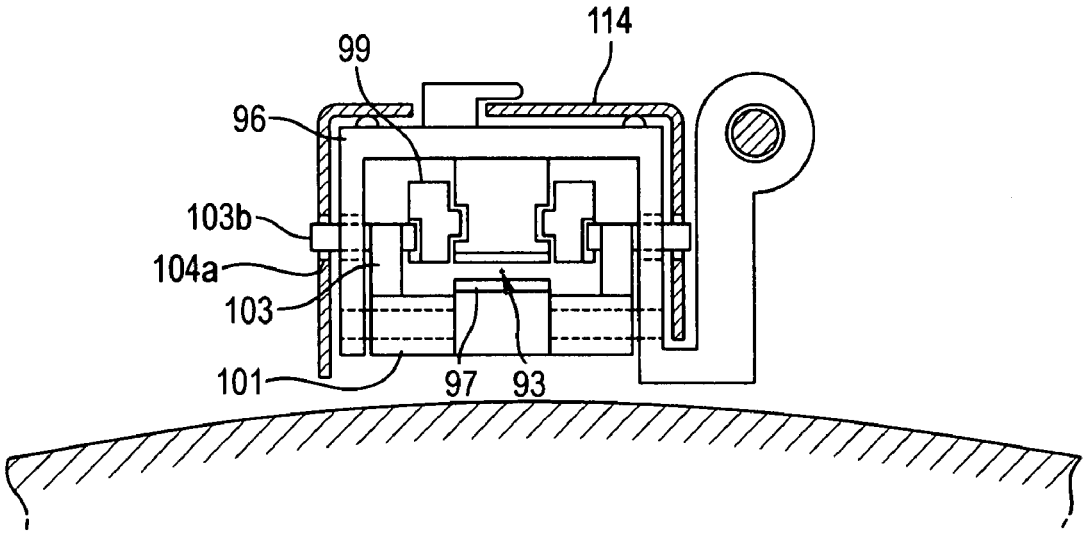
FIGS. 17A and 17B are cross-sectional views illustrating another example of a charging device having functions similar to those of the charging device shown in FIGS. 16A and 16B.
Figure 17B:
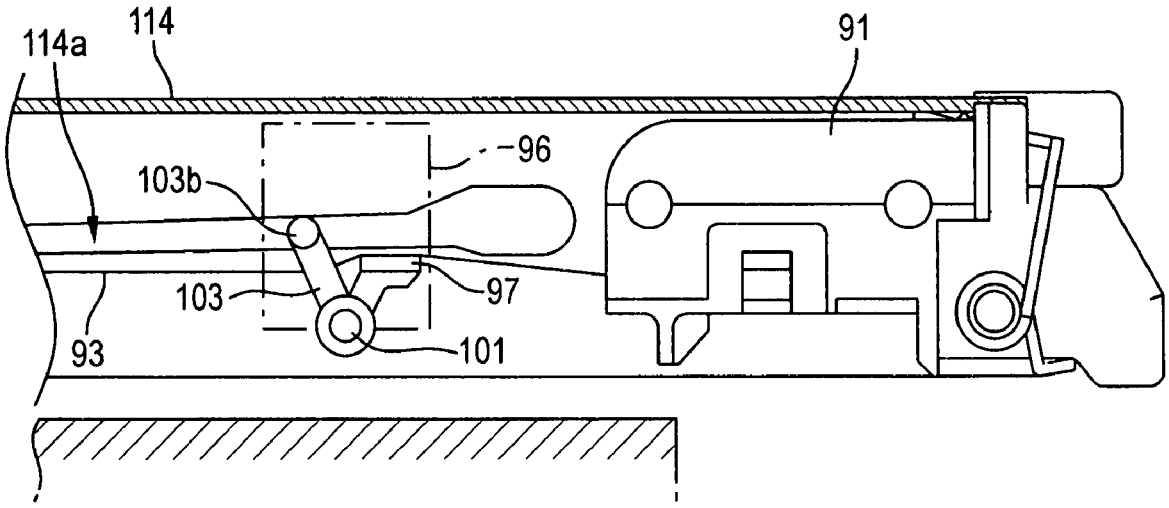

FIGS. 17A and 17B are a cross-sectional view and a schematic view illustrating another example of the charging device controlled so that as the support member moves, the contact pressure of the first pad to the electrode wire increases, similarly to the charging device shown in FIGS. 16A and 16B.

In the charging device according to this example, a guide slit 114*a* extending in the direction along the axis line of the electrode wire 93 is provided in a side surface of the shield case 114. Also, the outer projection 103*b* provided at the end portion of the second arm 103 is thrust into the guide slit 114*a*. Therefore, when the support body 96 moves from the front side to the rear side, the position of the outer projection 103*b* is regulated by an edge of the guide slit 114*a*. Similarly to the charging device shown in FIGS. 16A and 16B, the support shaft 101 gradually rotates as the support body 96 moves. The force of pushing the first pad 97 against the electrode wire 93 increases. Also, in the vicinity of each of the front end member 91 and the rear end member, the width of the guide slit 114*a* is increased. The restriction of the position of the outer projection 103*b* is released.

According to the aforementioned charging devices, the area of the region surrounding the region surrounding the electrode wire in the shield case provided between the front end member and the rear end member is maintained to be constant along the axis line of the electrode wire. However, the area of the region can be set to be reduced in the direction of the upstream side to the downstream side of the airflow.

Figure 18:
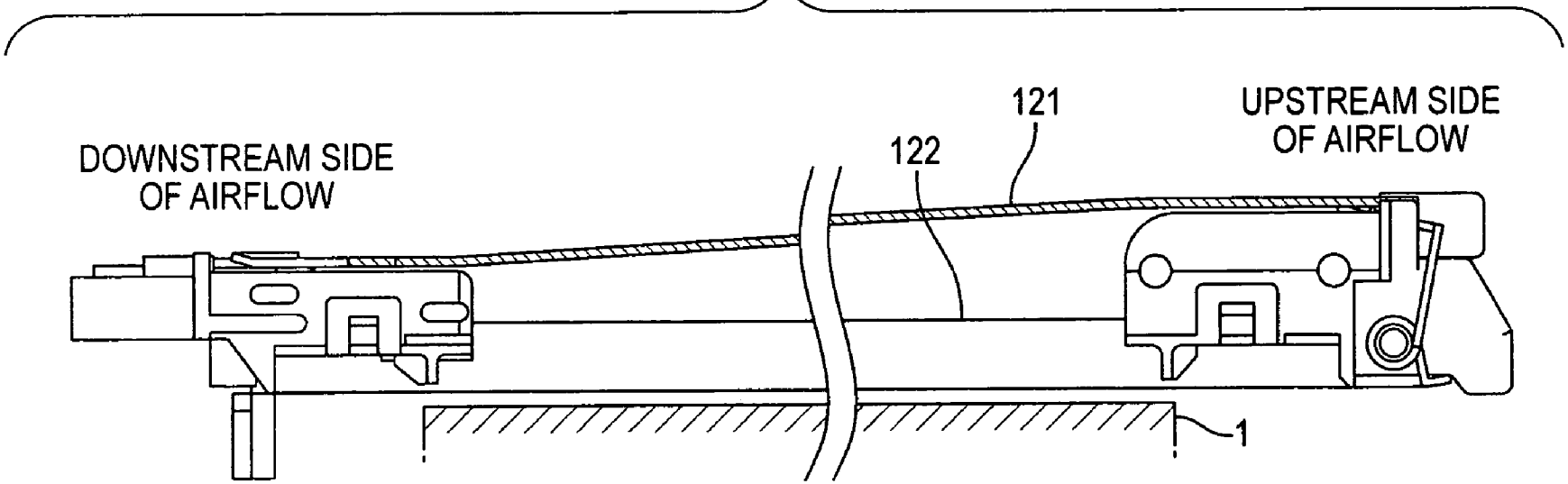
FIG. 18 is a schematic cross-sectional view illustrating an example of a modification whose configuration is obtained by changing a part of that of the charging device shown in FIGS. 11A, 11B and 12.
Figure 19A:
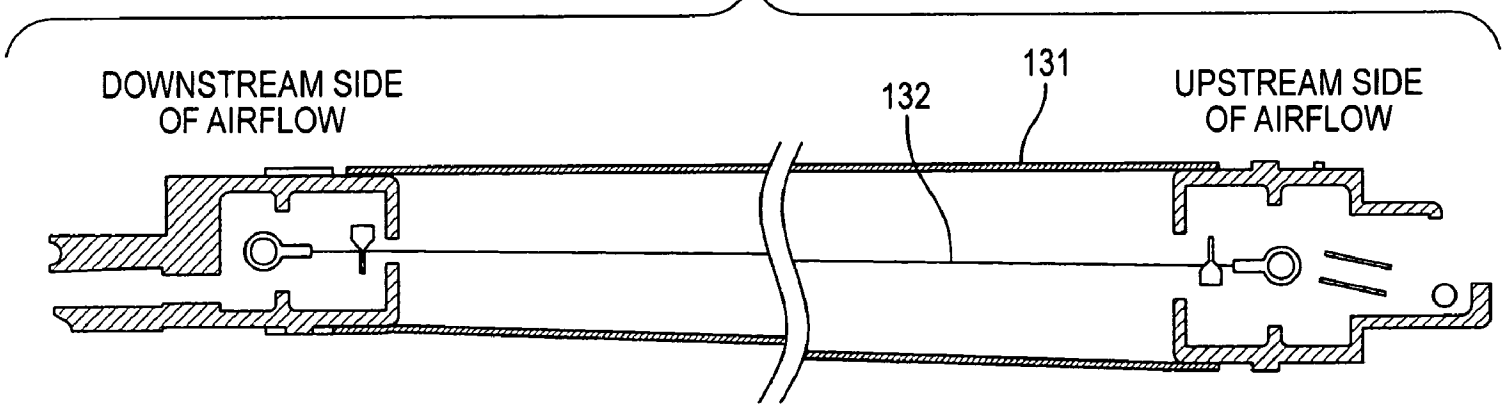
FIGS. 19A and 19B are schematic cross-sectional views illustrating another example of a modification whose configuration is obtained by changing a part of that of the charging device shown in FIGS. 11A, 11B and 12.
Figure 19B:
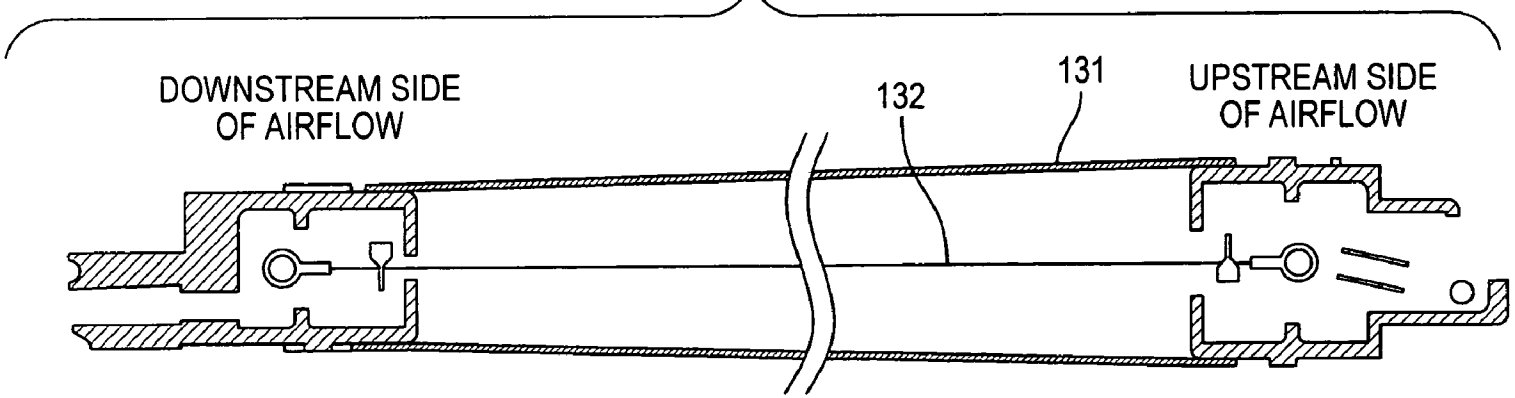

The charging device shown in FIG. 18 is adapted so that a rear-surface-side portion of the shield case 121 provided to face the photoreceptor drum 1 becomes closer to the electrode wire 122 toward the downstream side of the airflow. In a charging device shown in FIGS. 19A and 19B, two opposed side surface portions of the shield case 131 are set so that the distance between the tow side surface portions gradually decreases toward the downstream side from the upstream side of the airflow. The electrode wire 132 is stretched at both the upstream side and the downstream side of the airflow so that the distances of the electrode wire 132 to both the side surface portions are substantially equal to each other. Thus, in a case illustrated in FIG. 19A, the electrode wire 132 is inclined to a direction in which one of the side surface portions of the shield case is inclined. In a case illustrated in FIG. 19B, both the side surface portions of the shield case are inclined to the electrode wire 132 to become closer to each other.

Thus, the region surrounded by the shield case serving as the cover member is reduced at the downstream side of the airflow. Consequently, the airflow can be maintained in the peripheral portion surrounding the electrode wire serving as the charging member even at the downstream side. Accordingly, the particles of the foreign matters, which are dispersed, can be drifted to the downstream side.

Additionally, in a structure in which the rear surface side portion of the shield case 121 is set to be closer to the electrode wire 122, as illustrated in FIG. 18, the electric field between the electrode wire 122 and the photoreceptor drum 1 serving as the charged body is less changed between the upstream side and the downstream side of the airflow. Thus, it is little likely to cause a difference in charging characteristics therebetween, This is desirable for achieving more uniform charging, as compared with a structure in which the distance between the side surface portions is changed.

In a case where the space surrounding the charged body is limited, the structure adapted to reduce the distance between the side surface portions is effective. At that time, the electrode wire 132 serving as the charging member is stretched at a position the distances to both the side surface portions from which are substantially equal to each other. Consequently, the electric fields respectively generated at both sides of the electrode wire 132 are substantially equal in magnitude to each other. The charging characteristics can be suppressed from being changed between both the upstream side and the downstream side of the airflow.

In the case of using a charged body, whose surface having a curvature, such as the photoreceptor drum 1 serving as the charged body according to the present embodiment, when the distance between the side surface portions of the shield case 121 is reduced, the distance between the an end portion of the side surface portion, which is closer to the charged body, and the charged body is changed in the direction of the axis line of the electrode wire 33. According to the present embodiment, the distance between the charged body and the side portion of the shield case 121 at the downstream side is reduced. Thus, the distance between the charged body and an edge of the side surface portion, which is close to the charged body, at the downstream side is small, as compared with such a distance at the upstream side. Consequently, the length of the side surface portion of the shield case 121 is reduced toward the downstream side so that such distances at the downstream side and the upstream side are equal to each other.

Figure 20A:
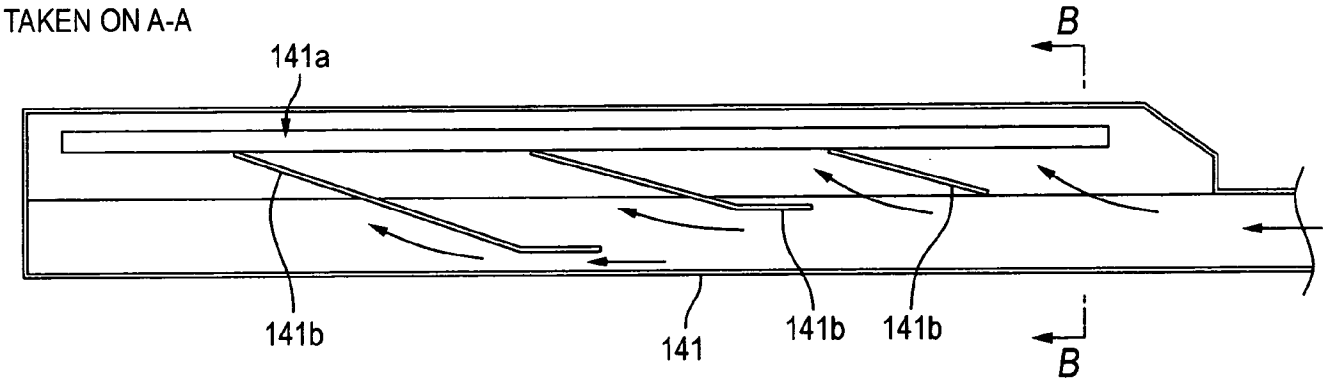
FIGS. 20A and 20B are schematic cross-sectional views illustrating another example of the configuration of a unit of supplying airflow to the charging device that can be used in the image forming apparatus shown in FIG. 1.
Figure 20B:
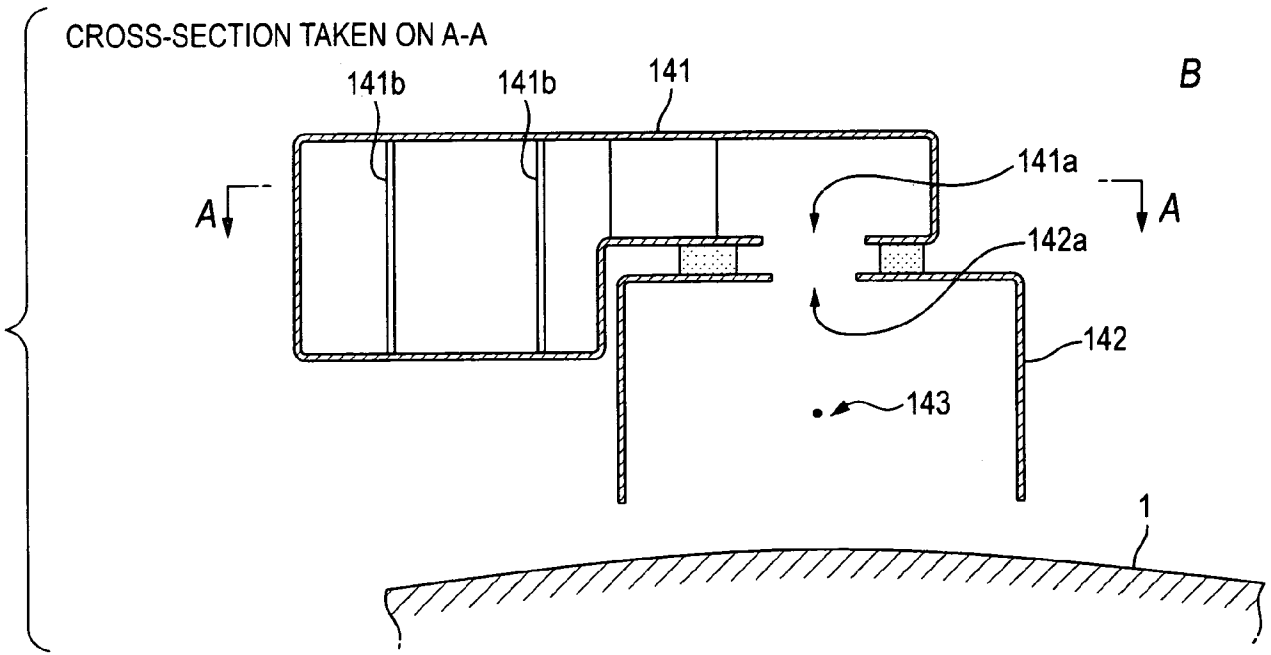

On the other hand, in the above charging devices, air is introduced from the front end member by the air supply/exhaust unit. Then, an airflow is formed along the electrode wire. Then, the air is exhausted from the rear end member. However, air may be introduced from the rear side and also may be exhausted from the front side, as long as the conditions for cleaning the electrode wire by being in contact with the cleaning member are matched with those according to the invention. An air supply/exhaust system according to the invention is not limited to that of introducing air through the end member. A system of providing a duct 141 along a shield case 142 as illustrated in FIGS. 20A and 20B, and supplying air from an opening portion 141*a* provided in the duct 141 and from a slit 142*a* provided in the shield case 142 to the region surrounding an electrode wire 143 can be employed. In such a structure, an airflow control plate 141*b* can be provided in the duct 141 formed along the shield case 142. Thus, an amount of air supplied within a range from the upstream side to the downstream side can be adjusted. Also, the airflow flowing in the region surrounding the electrode wire can be controlled.

The charging devices described above are used in the electrophotographic image forming apparatus to substantially uniformly charge the photoreceptor drum before image light is irradiated. However, the use of the charging devices according to the invention is not limited thereto. The charging device according to the invention can be used for charging and removal of electricity in the corona discharge apparatus and toner on the image holder, which are used to transfer toner images on the image holder, in the electrophotographic image forming apparatus and the image forming apparatus of the electrostatic recording type. Also, the charging device according to the invention can be used for charging a member other than the image holder, such as the photoreceptor drum on which an electrostatic latent image is formed, for example, an intermediate transfer body. Also, the invention can be applied to an apparatus which is used as an apparatus other than the image forming apparatus, and which needs the cleaning of a charging member.

What is claimed is:

1. A charging device comprising:

a charged body;

a charging member that is disposed at a predetermined distance from a surface of the charged body, and that extends parallel to the surface of the charged body, a charging voltage being applied between the charging member and the charged body;

a cleaning member that is in contact with the charging member, and that moves in an extending direction of the charging member to remove matter adhering to the charging member; and an air introduction path that introduces airflow at a position along the charging member flowing in an airflow direction along the extending direction of the charging member, wherein the cleaning member is in contact with the charging member when the cleaning member moves in the airflow direction such that a contact pressure of the cleaning member on the charging member increases as the cleaning member moves along the charging member, and wherein the cleaning member is separated from the charging member when the cleaning member moves in a direction opposite to the airflow direction in a state in which the airflow is generated.

2. The charging device as claimed in claim 1, further comprising:

a cover member that is supported to cover the charging member along the direction of the axis line thereof, wherein the cleaning member changes the contact pressure on the charging member by regulating a position of the cleaning member along a guide provided on the cover member.

3. A charging device comprising:

a charged body;

a charging member that is disposed at a predetermined distance from a surface of the charged body, and that extends parallel to the surface of the charged body, a charging voltage being applied between the charging member and the charged body;

a cleaning member that is in contact with the charging member, and that moves in an extending direction of the charging member to remove matter adhering to the charging member;

an air introduction path that introduces airflow at a position along the charging member flowing in an airflow direction along the extending direction of the charging member; and a cover member that is supported to cover the charging member along the extending direction of the charging member, wherein the cleaning member is in contact with the charging member when the cleaning member moves in the airflow direction, wherein the cleaning member is separated from the charging member when the cleaning member moves in a direction opposite to the airflow direction in a state in which the airflow is generated, wherein the cover member and the charged body surround a region having a cross-section area in a plane perpendicular to the direction of the axis line of the charging member, and wherein the cross-section area of the region is reduced in the airflow direction.

4. The charging device as claimed in claim 3, wherein the cover member has a rear surface portion provided at a rear portion of the charging member, and has side surface portions respectively provided on side portion of the charging members, and wherein the rear surface portion comes closer to the charging member in the airflow direction so that the area of the region is reduced.

5. The charging device as claimed in claim 3, wherein the cover member has a rear surface portion provided at a rear portion of the charging member, and that has side surface portions respectively provided on side portions of the charging member; and wherein one of the side surface portions of the charging member comes closer to the other side surface portion of the charging member in the airflow direction so that the area of the region is reduced.

6. The charging device as claimed in claim 5, wherein the charging member is disposed at a predetermined distance from the charged body having a curvature, and wherein, in a range from one of end portions to the other end portion in the extending direction of the charging member, a distance between the charged body and an edge closer to the charged body on one of the side surface portions of the charging member is substantially equal to a distance between the charged body and an edge closer to the charged body on the other side surface portion of the charging member.

7. A charging device comprising:

a charged body;

a charging member that is disposed at a predetermined distance from a surface of the charged body, and that extends parallel to the surface of the charged body, a charging voltage being applied between the charging member and the charged body;

a cleaning member that is in contact with the charging member, and that moves in an extending direction of the charging member to remove matter adhering to the charging member; and an air introduction path that introduces airflow at a position along the charging member flowing in an airflow direction along the extending direction of the charging member, wherein the cleaning member is in contact with the charging member when the cleaning member moves in the airflow direction, wherein the cleaning member is separated from the charging member when the cleaning member moves in a direction opposite to the airflow direction in a state in which the airflow is generated, and wherein the cleaning member stands ready at a downstream side in the airflow direction in a time period from termination of an operation of cleaning of the charging member to start of a next operation of cleaning of the charging member.

8. The charging device as claimed in claim 1, further comprising:

a support member that supports the cleaning member to be contactable with and separable from the charging member, and that moves in the extending direction of the charging member;

a position regulating unit that is connected to the support member to be able to perform relative displacement with respect thereto, and that regulates, according to a relative position thereof with respect to the support member, a position of the cleaning member with respect to the charging member; and an end portion supporting member that supports an end portion of the charging member, wherein the position regulating unit is moved with respect to the support member, in a case where the support member approaches the end portion supporting member, by contacting the position regulating unit with the end portion supporting member.

9. A charging device comprising:

a charging member that is disposed at a predetermined distance from a surface of a charged body, a charging voltage being applied between the charging member and the charged body;

a cleaning member that is in contact with the charging member, and that moves in a extending direction of the charging member to remove matter adhering to the charging member; and an air introduction path that introduces airflow at a position along the charging member flowing in an airflow direction along the extending direction of the charging member, wherein the cleaning member is in contact with the charging member when the cleaning member moves in the airflow direction such that a contact pressure of the cleaning member on the charging member increases as the cleaning member moves along the charging member, wherein a contact pressure between the cleaning member and the charging member when the cleaning member moves in a direction opposite to the airflow direction is set to be less than a contact pressure therebetween when the cleaning member moves in the airflow direction in a state in which the airflow is generated.

10. The charging device as claimed in claim 9, further comprising:

a cover member that is supported to cover the charging member along the direction of the axis line thereof, wherein the cleaning member changes the contact pressure on the charging member by regulating a position of the cleaning member along a guide provided on the cover member.

11. A charging device comprising:

a charging member that is disposed at a predetermined distance from a surface of a charged body, a charging voltage being applied between the charging member and the charged body;

a cleaning member that is in contact with the charging member, and that moves in a extending direction of the charging member to remove matter adhering to the charging member;

an air introduction path that introduces airflow at a position along the charging member flowing in an airflow direction along the extending direction of the charging member; and a cover member that is supported to cover the charging member along the extending direction of the charging member, wherein the cleaning member is in contact with the charging member when the cleaning member moves in the airflow direction, wherein a contact pressure between the cleaning member and the charging member when the cleaning member moves in a direction opposite to the airflow direction is set to be less than a contact pressure therebetween when the cleaning member moves in the airflow direction in a state in which the airflow is generated, wherein the cover member and the charged body surround a region having a cross-section area in a plane perpendicular to the direction of the axis line of the charging member, and wherein the cross-section area of the region is in the airflow direction.

12. The charging device as claimed in claim 11, wherein the cover member has a rear surface portion provided at a rear portion of the charging member, and has side surface portions respectively provided on side portion of the charging members, and wherein the rear surface portion comes closer to the charging member in the airflow direction so that the area of the region is reduced.

13. The charging device as claimed in claim 11, wherein the cover member has a rear surface portion provided at a rear portion of the charging member, and that has side surface portions respectively provided on side portions of the charging member; and wherein one of the side surface portions of the charging member comes closer to the other side surface portion of the charging member, in the airflow direction so that the area of the region is reduced.

14. The charging device as claimed in claim 13, wherein the charging member is disposed at a predetermined distance from the charged body having a curvature, and wherein in a range from one of end portions to the other end portion in the extending direction of the charging member, a distance between the charged body and an edge closer to the charged body on one of the side surface portions of the charging member is substantially equal to a distance between the charged body and an edge closer to the charged body on the other side surface portion of the charging member.

15. A charging device comprising:

a charging member that is disposed at a predetermined distance from a surface of a charged body, a charging voltage being applied between the charging member and the charged body;

a cleaning member that is in contact with the charging member, and that moves in a extending direction of the charging member to remove matter adhering to the charging member; and an air introduction path that introduces airflow at a position along the charging member flowing in an airflow direction along the extending direction of the charging member, wherein the cleaning member is in contact with the charging member when the cleaning member moves in the airflow direction, wherein a contact pressure between the cleaning member and the charging member when the cleaning member moves in a direction opposite to the airflow direction is set to be less than a contact pressure therebetween when the cleaning member moves in the airflow direction in a state in which the airflow is generated, and wherein the cleaning member stands ready at a downstream side in the airflow direction in a time period from termination of an operation of cleaning of the charging member to start of a next operation of cleaning of the charging member.

16. The charging device as claimed in claim 9, further comprising:

a support member that supports the cleaning member to be contactable with and separable from the charging member, and that moves in the extending direction of the charging member;

a position regulating unit that is connected to the support member to be able to perform relative displacement with respect thereto, and that regulates, according to a relative position thereof with respect to the support member, a position of the cleaning member with respect to the charging member; and an end portion supporting member that supports an end portion of the charging member, wherein the position regulating unit is moved with respect to the support member, in a case where the support member approaches the end portion supporting member, by contacting the position regulating unit with the end portion supporting member.

17. An image holder unit comprising:

an image holder that has a photoreceptor layer provided around an endless circumferential surface, and that has a surface adapted to move;

a charging member that is disposed at a predetermined distance from a surface of the image holder, and that extends in a direction perpendicular to a direction of movement of the image holder, a charging voltage being applied between the charging member and the charged body;

a cleaning member that is in contact with the charging member, and that moves in an extending direction of the charging member to remove matter adhering to the charging member; and an air introduction path that introduces airflow at a position along the charging member flowing in an airflow direction along the extending direction of the charging member, the image holder, the charging member, the cleaning member, and the air introduction path being formed substantially integrally with an image forming apparatus body, wherein the cleaning member is in contact with the charging member when the cleaning member moves in the airflow direction such that the contact pressure of the cleaning member on the charging member increases as the cleaning member moves along the charging member, and wherein the cleaning member is separated from the charging member when the cleaning member moves in a direction opposite to the airflow direction in a state in which the airflow is generated.

18. An image forming apparatus comprising:

an image holder that has a photoreceptor layer provided around an endless circumferential surface;

a charging device that charges the circumferential surface of the image holder to a predetermined potential level;

an image exposure device that forms a latent image by irradiating image light onto the circumferential surface of the image holder;

a developing device that forms a toner image by transferring toner to the latent image formed on the image holder;

a transfer device that transfers the toner image formed on image holder to a transferred material; and an air supply and exhaust device that at least supplies air to the charging device and exhausts air from the charging device such that an airflow flows from a front side to a rear side along the charging member, the charging device comprising:

a charging member that extends in a direction of width of an endless circumference, and that is disposed at a predetermined distance from the endless circumferential surface to extend from a front side to a rear side, a charging voltage being applied between the charging member and the charged body; and a cleaning member that is in contact with the charging member, and that moves in an extending direction of the charging member to remove matter adhering to the charging member;

wherein the cleaning member is in contact with the charging member when the cleaning member moves in a direction of airflow such that a contact pressure of the cleaning member on the charging member increases as the cleaning member moves along the charging member, and wherein, when the cleaning member moves in a direction opposite to the airflow in a state in which the airflow is generated, the cleaning member is separated from the charging member, or a contact pressure between the cleaning member and the charging member is set to be less than a contact pressure therebetween when the cleaning member moves in the direction of airflow.

19. The charging device as claimed in claim 1, further comprising a cover member that is supported to cover the charging member along the extending direction of the charging member.

* * * * *